US007316328B2

(12) United States Patent
Yuyama et al.

(10) Patent No.: US 7,316,328 B2
(45) Date of Patent: Jan. 8, 2008

(54) DEVICE FOR DISPENSING MEDICINE

(75) Inventors: Shoji Yuyama, Osaka (JP); Yasuhiro Shigeyama, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 253 days.

(21) Appl. No.: 10/531,581

(22) PCT Filed: Jun. 9, 2003

(86) PCT No.: PCT/JP03/07241

§ 371 (c)(1),
(2), (4) Date: Apr. 18, 2005

(87) PCT Pub. No.: WO2004/034955

PCT Pub. Date: Apr. 29, 2004

(65) Prior Publication Data

US 2006/0097001 A1 May 11, 2006

(30) Foreign Application Priority Data

Oct. 18, 2002 (JP) ..... 2002-305165
Mar. 27, 2003 (JP) ..... 2003-088292

(51) Int. Cl.
*B65H 1/08* (2006.01)

(52) U.S. Cl. ..... 221/227; 221/279; 221/57; 312/61

(58) Field of Classification Search ..... 221/57, 221/227, 279
See application file for complete search history.

(56) References Cited

U.S. PATENT DOCUMENTS 3,777,931 A * 12/1973 Fleming ..... 221/57
5,263,596 A * 11/1993 Williams ..... 221/279
6,138,865 A 10/2000 Gilmore (Continued)

FOREIGN PATENT DOCUMENTS

EP 1 118 318 7/2001

(Continued)

OTHER PUBLICATIONS

Supplementary European Search Report (in English language) issued Aug. 23, 2007 in European Application NO. EP 03 73 3317, which is a foreign counterpart to the present U.S. application.

*Primary Examiner*—Gene O. Crawford
*Assistant Examiner*—Timothy Waggoner
(74) *Attorney, Agent, or Firm*—Wenderoth, Lind & Ponack, L.L.P.

(57) ABSTRACT

A device for dispensing medicine includes a dispensing device body (1), a cassette (2) fixed removably to the dispensing device body in order to contain medicines while arranging, and a pushing mechanism (18) for pushing out the medicines in the cassette (2) toward one end side. The cassette (2) includes a cover (6) and a stopping/receiving part (17) disposed internally in the longitudinal direction. The pushing mechanism (18) includes an abutting part (19*a*) contained in the cassette (2) and abutting against the medicines, a biasing part (20) for biasing the abutting part (19*a*) against the medicine, and a stopping part (21) stopping at the stopping/receiving part (17) of the cassette (2) only when the cover (6) is opened. Consequently, the cassettes (2) can be arranged at a high density and a desired number of medicines can be dispensed surely.

14 Claims, 29 Drawing Sheets

U.S. PATENT DOCUMENTS

| | | | | |
|---|---|---|---|---|
| 6,189,727 | B1 * | 2/2001 | Shoenfeld | 221/279 |
| 6,370,841 | B1 * | 4/2002 | Chudy et al. | 700/235 |
| 6,691,891 | B2 * | 2/2004 | Maldonado | 221/279 |

FOREIGN PATENT DOCUMENTS

| | | |
|---|---|---|
| EP | 1285865 | 2/2003 |
| JP | 7-285674 | 10/1995 |
| JP | 2000-24085 | 1/2000 |
| JP | 2000-072204 | 3/2000 |
| JP | 2002-11072 | 1/2002 |
| WO | 97/24702 | 7/1997 |
| WO | 01/72612 | 10/2001 |

* cited by examiner

DEVICE FOR DISPENSING MEDICINE

BACKGROUND OF THE INVENTION

1. Technical Field

The present invention relates to a device for dispensing medicine capable of dispensing medicines one by one.

2. Description of the Related Art

Conventionally, medicines are contained in cassettes fixed to a stock shelf in such a way that the cassettes can be pulled out. According to need, a cassette is pulled out from the storage shelf so that a medicine contained in the cassette can be extracted (see, e.g., JP H10-201825A).

However, in the stock shelf, the medicine should be grasped from an upper aperture of the pulled-out cassette, and therefore the contained medicine is sometimes difficult to extract depending on the arranged position of the cassette. Moreover, as the number of medicines contained in the cassette increases, not only the cassette itself is difficult to pull out but also the medicines contained on the inner side of the cassette are hard to extract. Further, in the case of, for example, a medicine such as anticancer drugs whose administration is strictly restricted, it is not desirable to allow free access to the medicine. However, adopting the structure featuring such solution as locking will deteriorate workability and also require an additional operation to confirm that the medicines are securely locked up.

SUMMARY OF THE INVENTION

An object of the present invention is to provide a device for dispensing medicine in which cassettes are downsized so as to be arranged at a high density and a desired number of medicines can be dispensed surely.

In order to solve the above object, according to the present invention, there is provided a device for dispensing medicine including a dispensing device body, a cassette fixed removably to the dispensing device body in order to contain medicines while arranging, and pushing means for pushing out the medicines in the cassette toward one end side. The cassette includes a cover to arrange the contained medicines and a stopping/receiving part disposed internally in a longitudinal direction, and the pushing means includes an abutting part contained in the cassette and abutting against the medicines, an biasing part for biasing the abutting part against the medicine so as to press and arrange the medicines from one end side, and a stopping part stopping at the stopping/receiving part of the cassette only when the cover is opened so that the abutting part is prevented from pressing the medicines in conformity to biasing force of the biasing part, wherein when the abutting part is moved, the stopping part is released from the stopping/receiving part and the abutting part is moved to an arbitrary position so as to allow positioning.

This construction allows compact structure of the cassette so that the cassette can be arranged at a high density in the dispensing device body. Moreover, the operation of the biasing part eliminates the necessity of a specific driving source, allowing easy extraction of medicines. Further, in the pushing means, the stopping part is stopped at the stopping/receiving part in the state in which the cover is open, thereby preventing failures such as fallout of the medicines during supplementing operation of medicines.

It is preferable that the pushing means is constituted such that the biasing part and the stopping part are housed in a casing and one end face of the casing functions as the abutting part, which allows simple and compact formation of the pushing means.

It is preferable that the cassette includes fallout preventing means for preventing contained medicines from falling out in the state in which the cassette is dismounted from the dispensing device body. The dispensing device body includes a canceling part for canceling fallout prevention by the fallout preventing means when the cassette is mounted on or dismounted from the dispensing device body and a dispensing part for allowing the medicines in the cassette to be dispensed one by one, which ensures prevention of the medicines from falling out when the cassette is mounted on or dismounted from the dispensing device body and allows the medicines to be dispensed surely one by one.

It is preferable that the stopping/receiving part is constituted of a stopping rack composed of a plurality of recess parts juxtaposed along the longitudinal direction of the cassette, and the stopping part has a gear which turns in response to an opening and closing operation of the cover to engage with the stopping rack, which makes it possible to ensure positioning of the pushing means when the cover is opened.

It is preferable that the pushing means includes a gear engaged with the stopping rack and an oil dumper integrated with the gear, and the biasing part is constituted of a constant-load spring, which enables the pushing means to smoothly and reasonably push out medicines.

The dispensing part should be constituted of a rotor having a circular plane allowing medicines to be held one by one. The rotor is rotated by power transmitted through a gear provided on a rotating shaft, the gear is engaged with a rack formed on a rod, and the rod is able to reciprocate.

With this arrangement, simple reciprocal movement of the rod allows the rotor to rotate through the rack and the gear which are engaged with each other in advance, making it possible to ensure that the operation is sufficient in stability.

Further, it is preferable that the dispensing part is constituted of a rotor having a circular plane allowing medicines to be held one by one, the rotor being rotated by power transmitted through a gear provided on a rotating shaft, the gear being engaged with a drive gear which drives rotationally, the drive gear being able to come into contact with or break away from the gear of each rotor in a plurality of cassettes, which enables a single-unit drive gear to dispense medicines from a plurality of cassettes.

It is preferable that the fallout prevention means is constituted of a plate spring provided on one end aperture of the cassette. The plate spring is elastically deformable from being at a fallout prevention position for preventing medicines from falling out from the cassettes to being at a medicine dispensing position for permitting the dispensing part to dispense medicines.

This enables the plate spring to surely prevent medicines from falling out from the cassette in the state where the cassette is dismounted from the dispensing device body. Moreover, since medicines are elastically supported by the plate spring while the cassette is mounted on the dispensing device body, the medicines can be smoothly dispensed.

It is preferable that the plate spring elastically supports a head medicine so as not to move the position of the next medicine when the head medicine received on the circular plane of the rotor is dispensed from the cassette by rotation of rotor, which allows smooth rotating operation of the rotor.

It is preferable that the dispensing device body includes a pusher for driving the dispensing part of the cassette to dispense medicines and a stopping/retaining member geared to the pusher to engage with or disengage from the cassette, which makes it possible to prevent failures such as careless dismounting of the cassette during dispensing of medicines.

DETAILED DESCRIPTION OF THE PREFERRED EMBODIMENTS

Hereinbelow, the embodiments of the present invention will be described with reference to the accompanying drawings.

Figure 1:
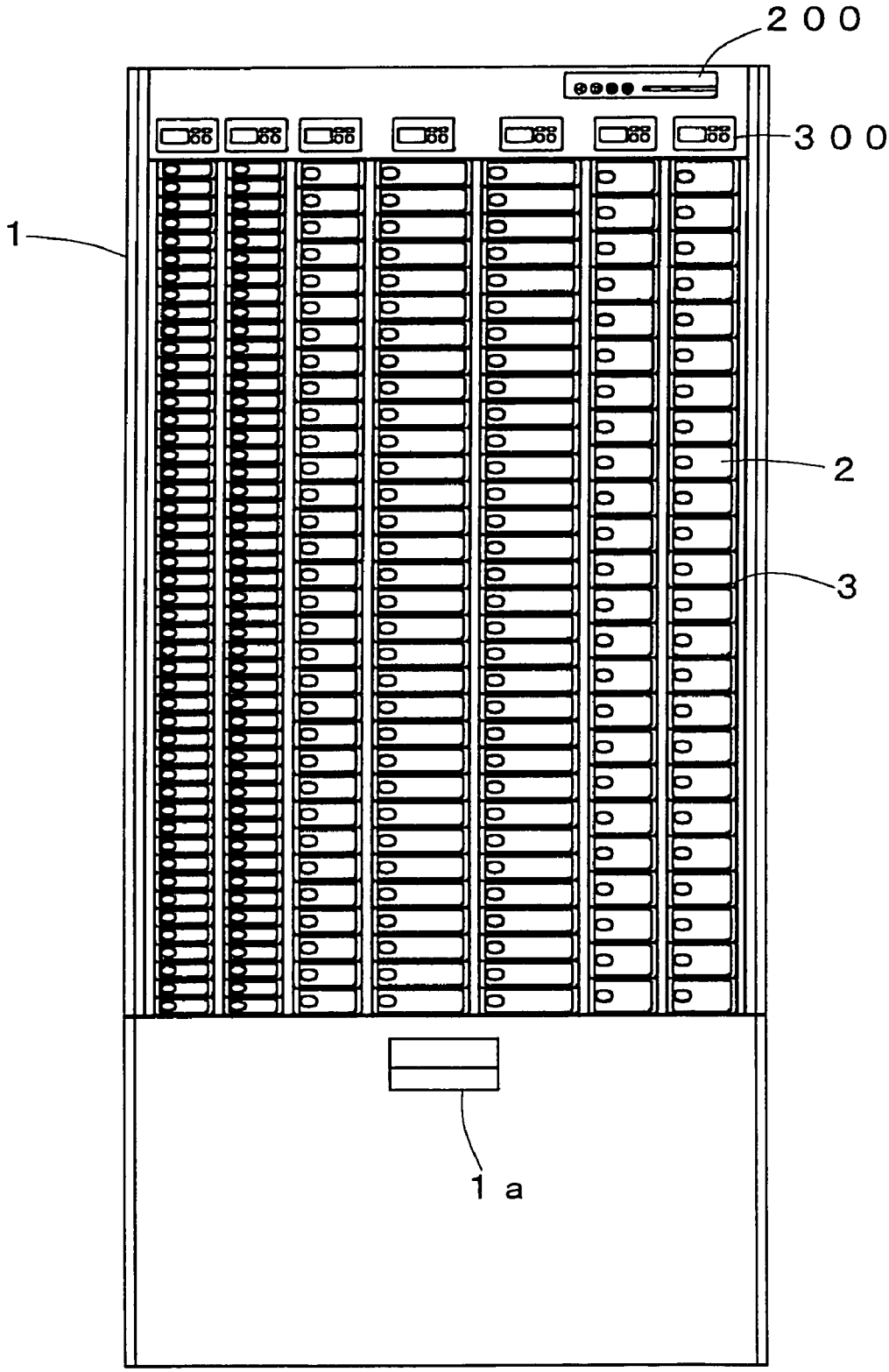
FIG. 1 is a front view showing a device for dispensing medicine according to the present embodiment.
Figure 2:
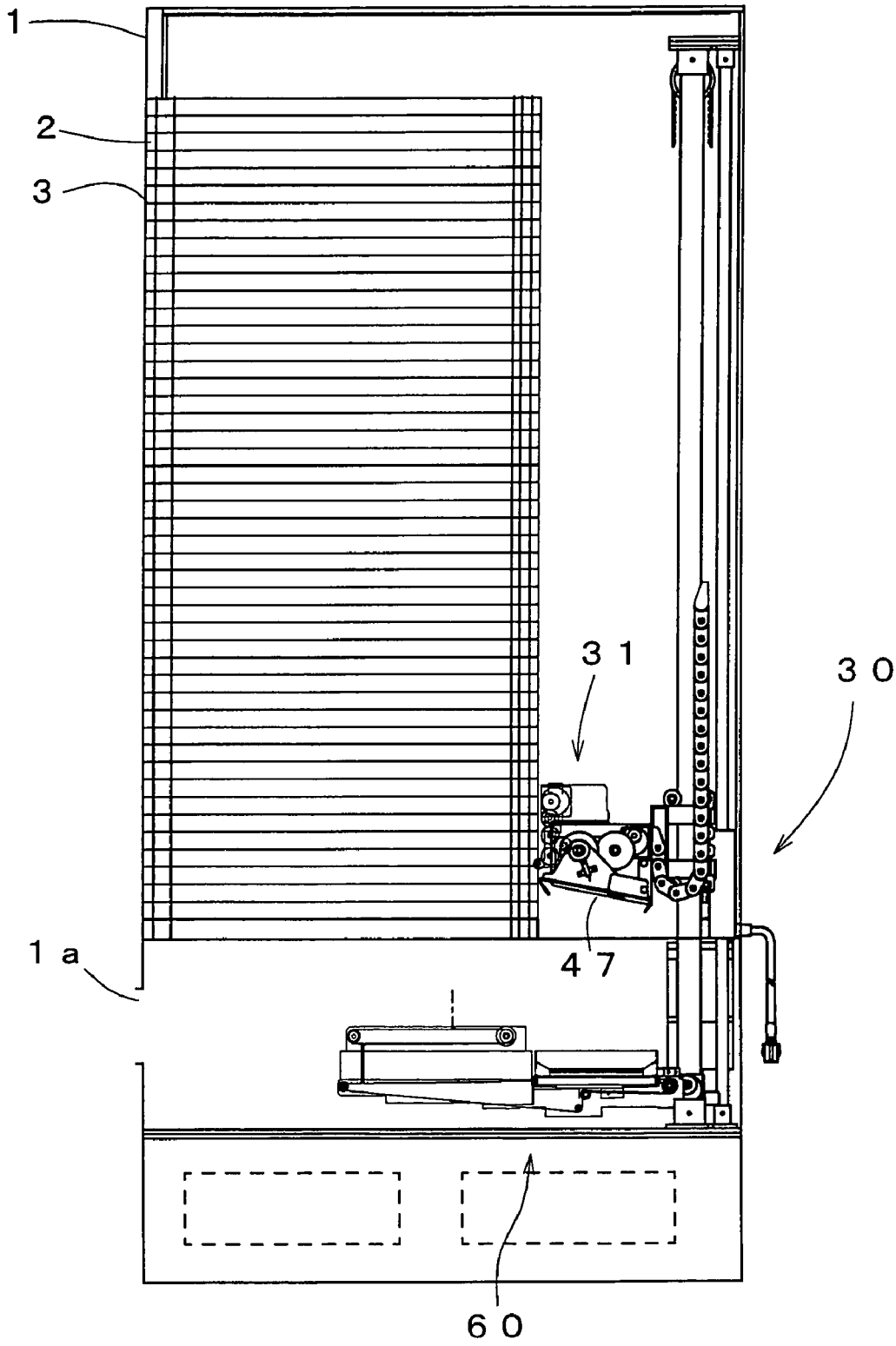
FIG. 2 is a side cross sectional view showing the device for dispensing medicine.

FIG. 1 and FIG. 2 show a device for dispensing medicine according to the present embodiment. The device for dispensing medicine is structured such that cassettes 2 are mounted on a dispensing device body 1 in matrix form. Medicines D in each of the cassettes 2 are dispensed by a dispensing unit 30 to a dispensing outlet 1*a* on the lower front side of the dispensing device body 1.

Figure 3:
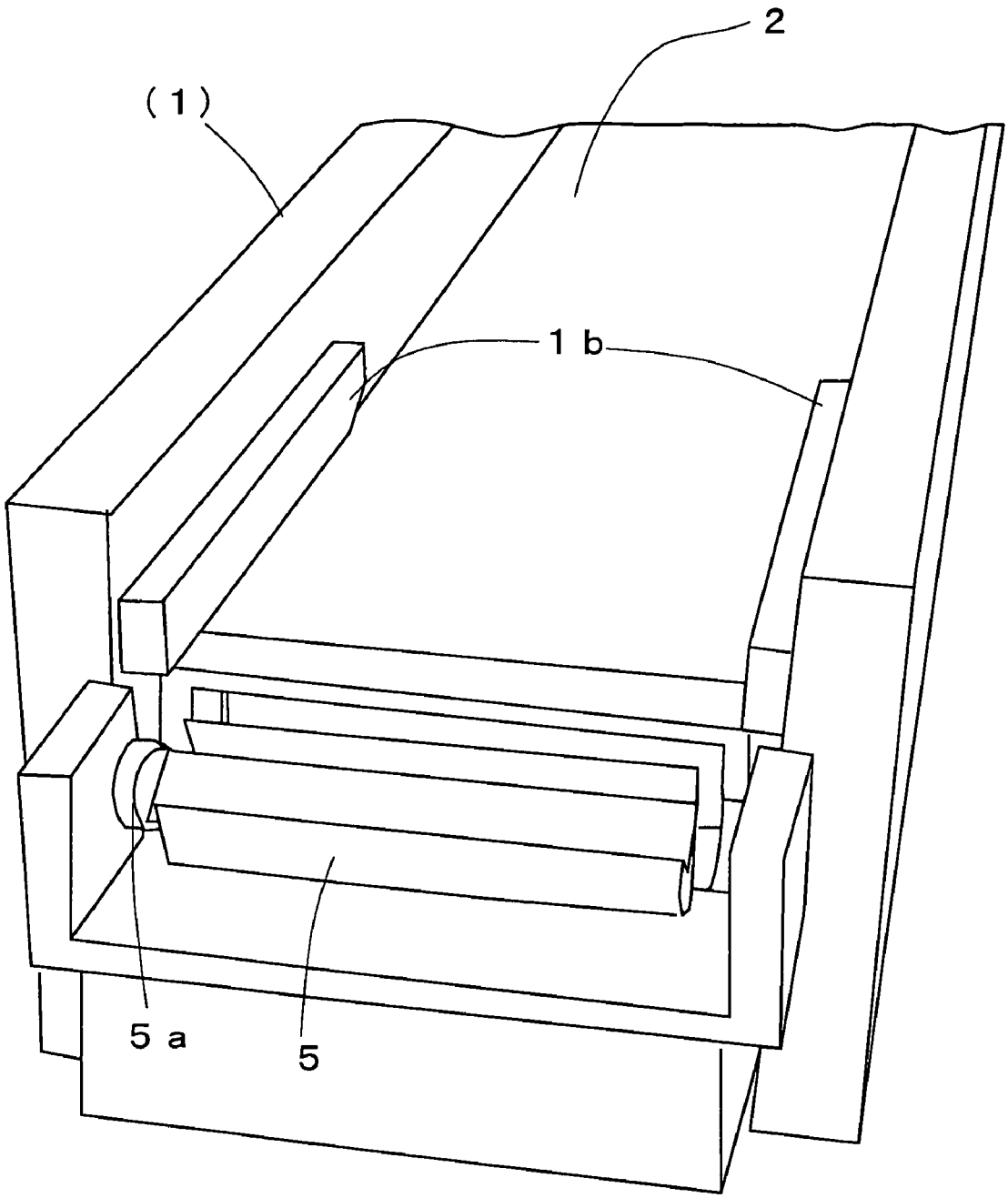
FIG. 3 is a fragmentary perspective view showing a cassette in the state of being mounted on a back face side of the device for dispensing medicine.
Figure 4A:
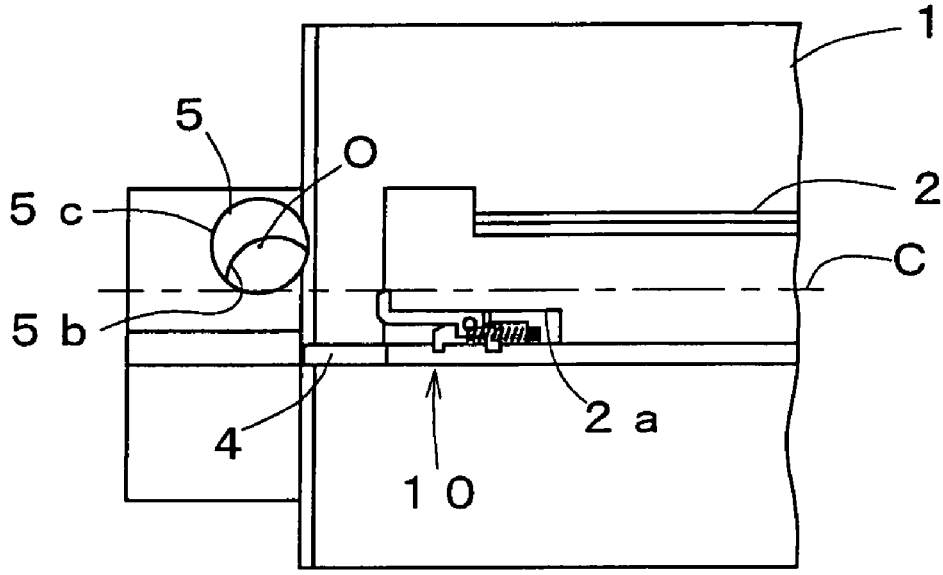
FIG. 4A is a side view showing the cassette in the state before being mounted on the back face side of the device for dispensing medicine.
Figure 4B:
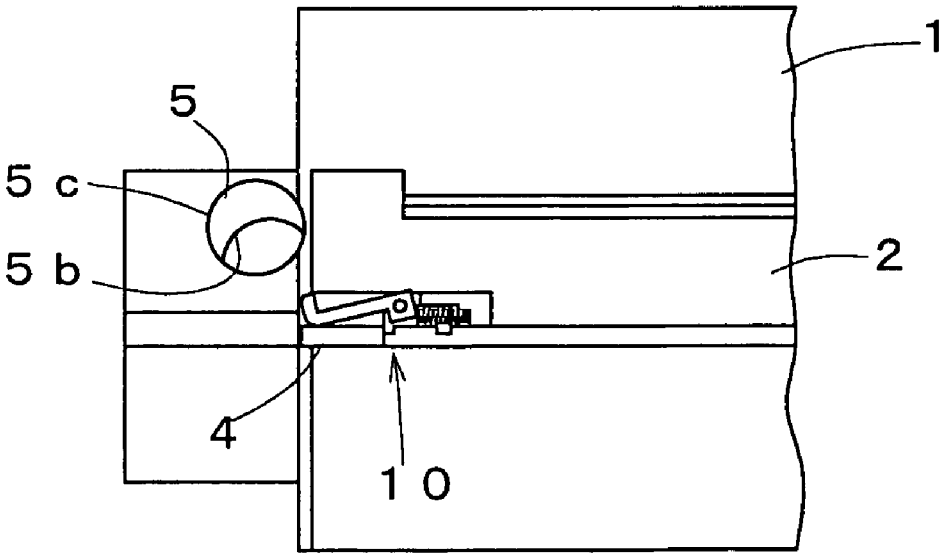
FIG. 4B is a side view showing the cassette of FIG. 4A in the state after being mounted.
Figure 4C:
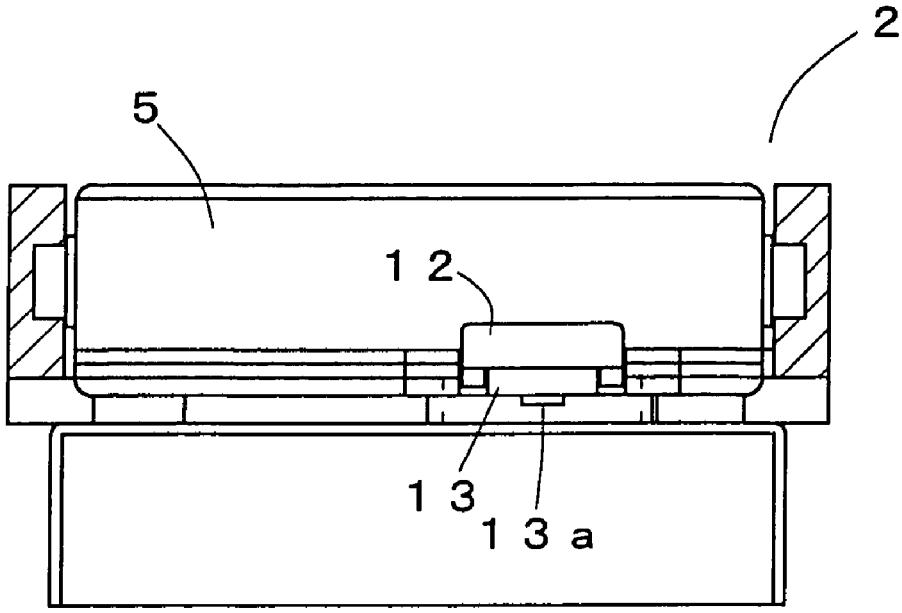
FIG. 4C is a back view showing the cassette.

The dispensing device body 1 has a plurality of stock shelves 3 on which the cassettes 2 are mounted. On the inner side of each of the stock shelves 3, a cancel part and a dispensing part are formed. As shown in FIG. 4A, the cancel part is constituted of a protrusion 4 which abuts against a later-described stopper cancel member 13. As shown in FIG. 3 and FIG. 4A, the dispensing part is constituted of a rotor 5 which rotates by the operation of a later-described rotor drive member 31 through a gear 5*a* provided on one end portion of a rotating shaft. The rotor 5 receives a medicine D (herein an ampul) from the cassette 2 on a circular plane 5*b* formed by cutting away, and rotates so as to support the next medicine D on an outer circumferential plane 5*c*, so that only the medicine D received on the circular plane 5*b* is discharged. The center of rotation O of the rotor 5 is positioned above a center line C of a discharge route of medicines. Moreover, the circular plane 5*b* is in the shape which allows dispensing of only one medicine D even if the medicine D has a maximum outer diameter and which prevents interference with the next medicine D. This allows the rotors 5 of the same shape to be used to handle a plurality of medicines D different in outer diameter size. It is to be noted that reference numeral 1*b* denotes guide pieces for guiding the rear end portion of the cassette 2.

Figure 5:
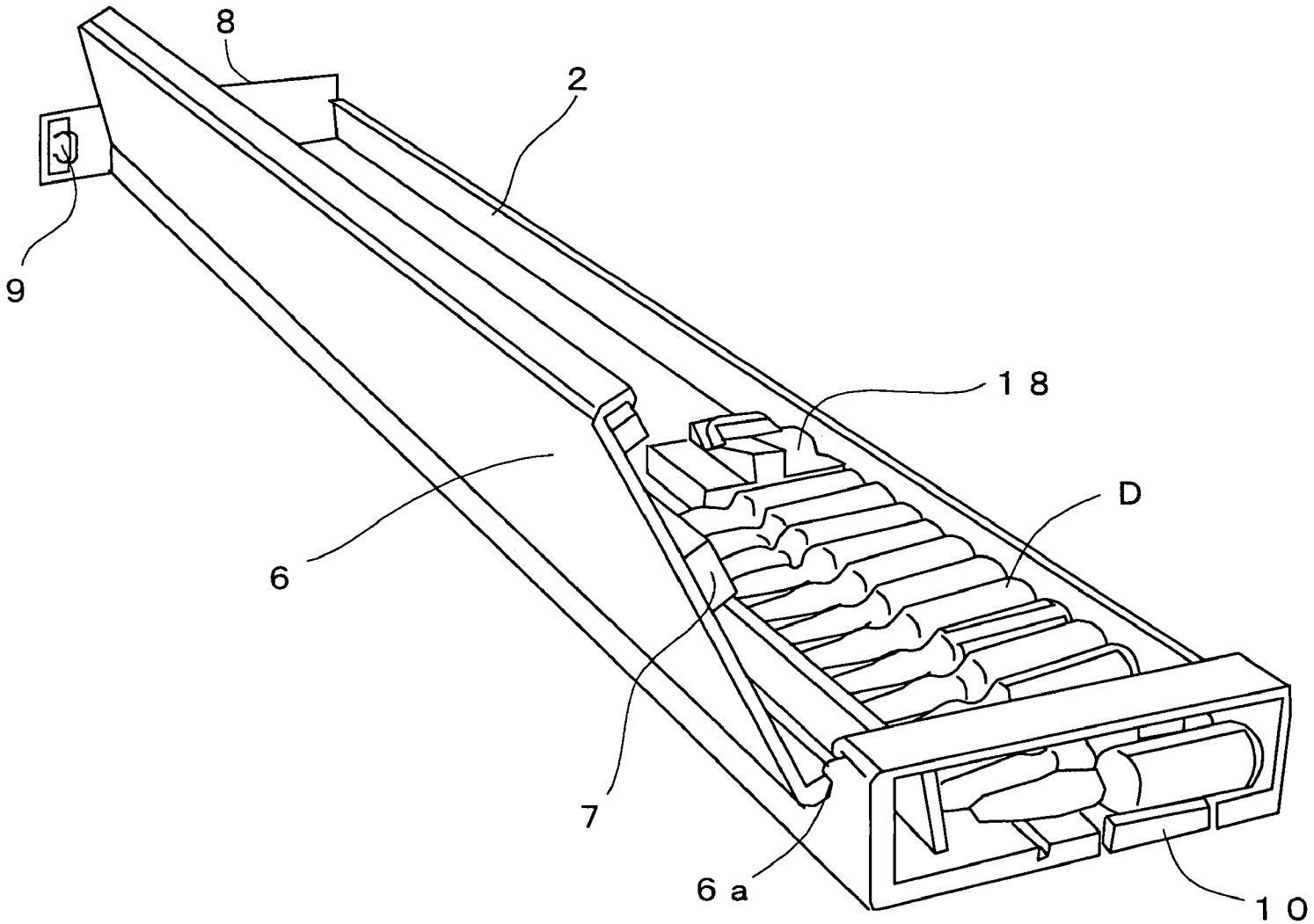
FIG. 5 is a perspective view as viewed from the back face side of the cassette.

As shown in FIG. 5, the cassette 2 is in a vertically-long box shape and its upper face is closed by a cover 6 provided movably around a spindle 6*a*. The cover 6 has a pressing part 7 formed so as to extend in the longitudinal direction in its center portion, the pressing part 7 being able to abut against the contained medicines D so as to offer a desired array state.

Figure 17:
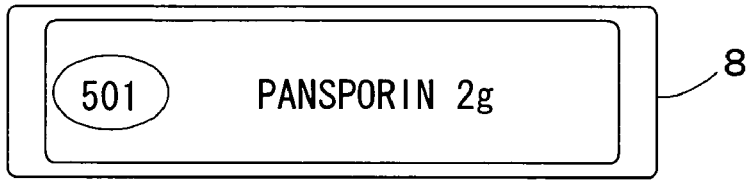
FIG. 17 is a front view showing a display part on the front face of the cassette.

One end face of the cassette 2 (positioned on the front face side of the dispensing device body 1) serves as a display part 8 carrying cassette No., name of contained medicine D and capacity as shown in FIG. 17, and in the vicinity of the display part 8, a stopping part 9 for maintaining the cassette 2 in the state of being closed with respect to the stock shelf 3 is formed. It is to be noted that the display part 8 may carry the external picture of the contained medicine D (ample), a barcode to identify the medicine D and the like in addition to the cassette No. and other information.

Figure 4D:
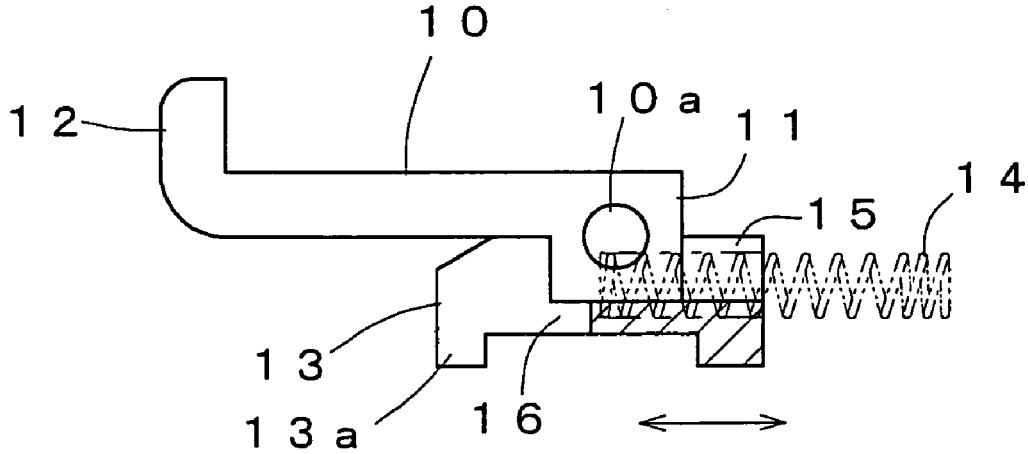
FIG. 4D is a side view showing a stopper.

As shown in FIGS. 4A to 4D, on the other end side of the cassette 2, a stopper 10 is provided as a fallout prevention means. The stopper 10 is disposed in a recess part 2*a* formed on the lower face of the cassette 2 and is supported rotatably around a shaft part 10*a* protruding from both sides as shown in FIG. 4D. A rectangular part 11 is formed around the shaft part 10*a* and its end curves at almost right angles to serve as a fallout prevention part 12. The stopper 10 is positioned at a closing position at which the stopper cancel member 13 prevents the medicine D from falling out of the cassette 2 and at an opening position at which fallout is allowed. The stopper cancel member 13 is biased by a spring 14 so as to protrude in the horizontal direction. On the stopper cancel member 13, a guide part 15 and a relief part 16 are formed. The guide part 15 is formed to have a laterally-positioned U shape cross section so as to be able to guide the bottom face and the lower side face of the rectangular part 11 in the stopper 10. The relief part 16 is constituted of only wall faces of both sides so that the stopper 10 can be rotated by pressing the stopper cancel member 13 against the biasing force of the spring 14. It is to be noted that reference numeral 13*a* denotes a contact piece, which is pressed by a protrusion 4 of the dispensing device body 1.

Figure 6:
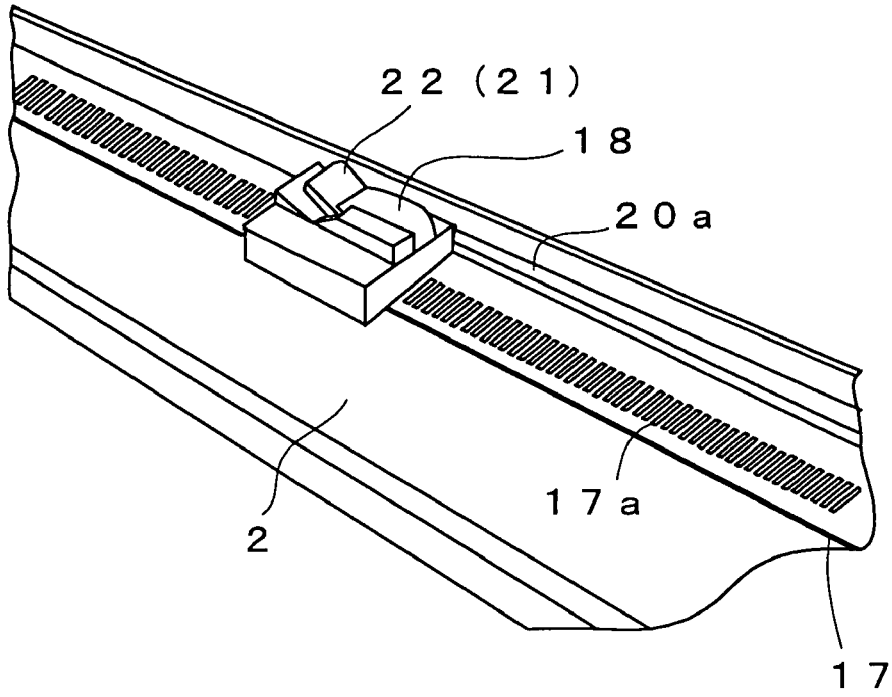
FIG. 6 is a fragmentary perspective view showing the inside of the cassette.
Figure 7:
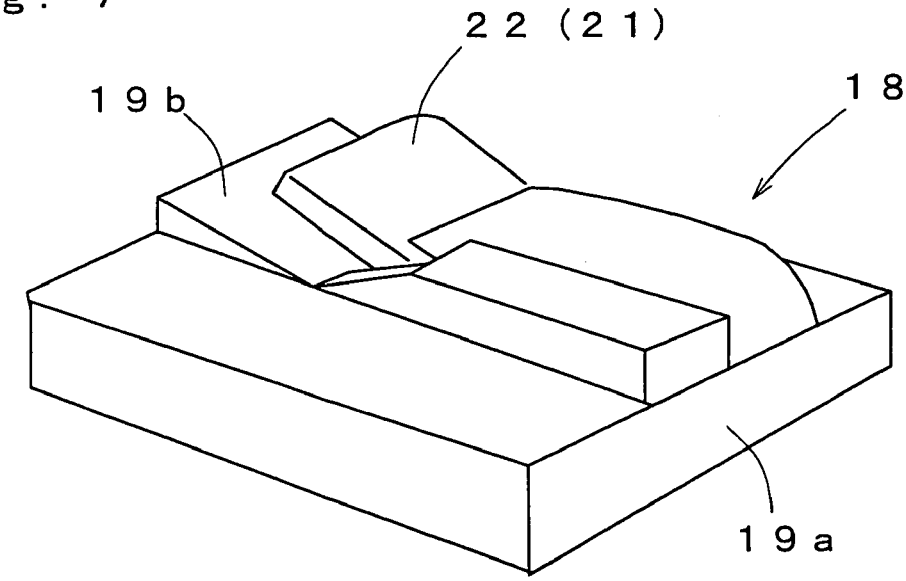
FIG. 7 is a perspective view showing a pushing unit.
Figure 8A:
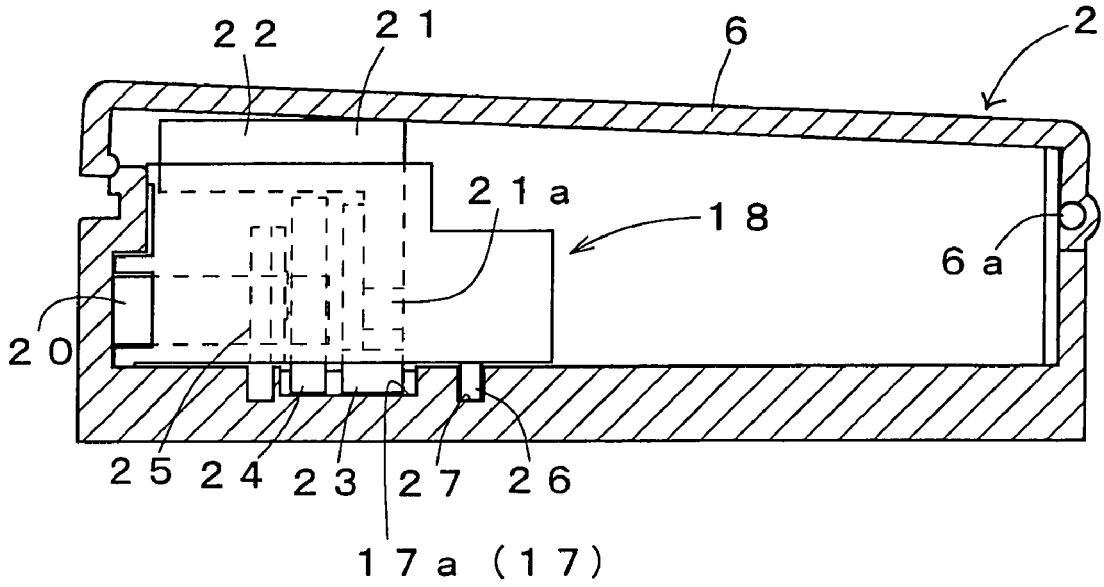
FIG. 8A is a cross sectional view in the portion where the pushing unit is located in the state in which a cover of the cassette is opened.
Figure 8B:
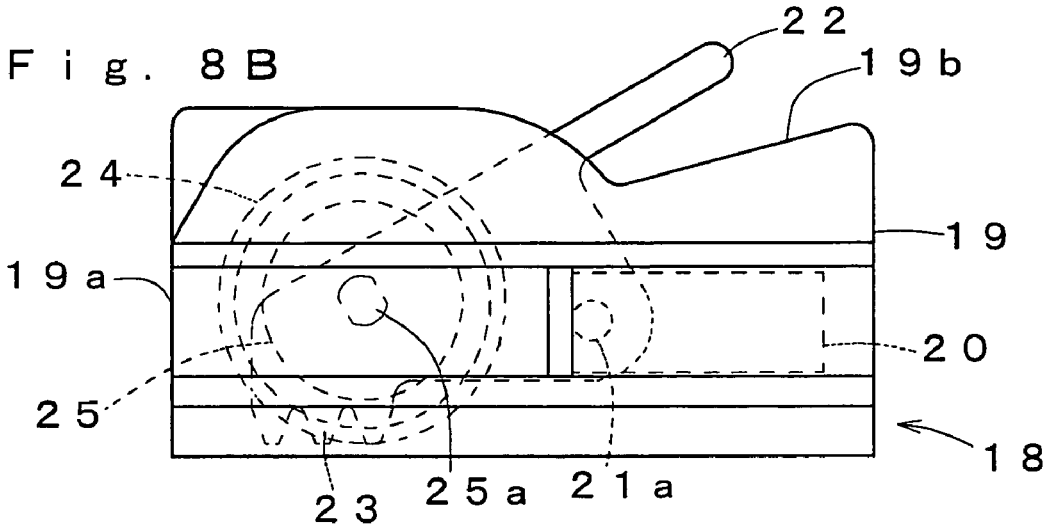
FIG. 8B is a side view showing the pushing unit.
Figure 8C:
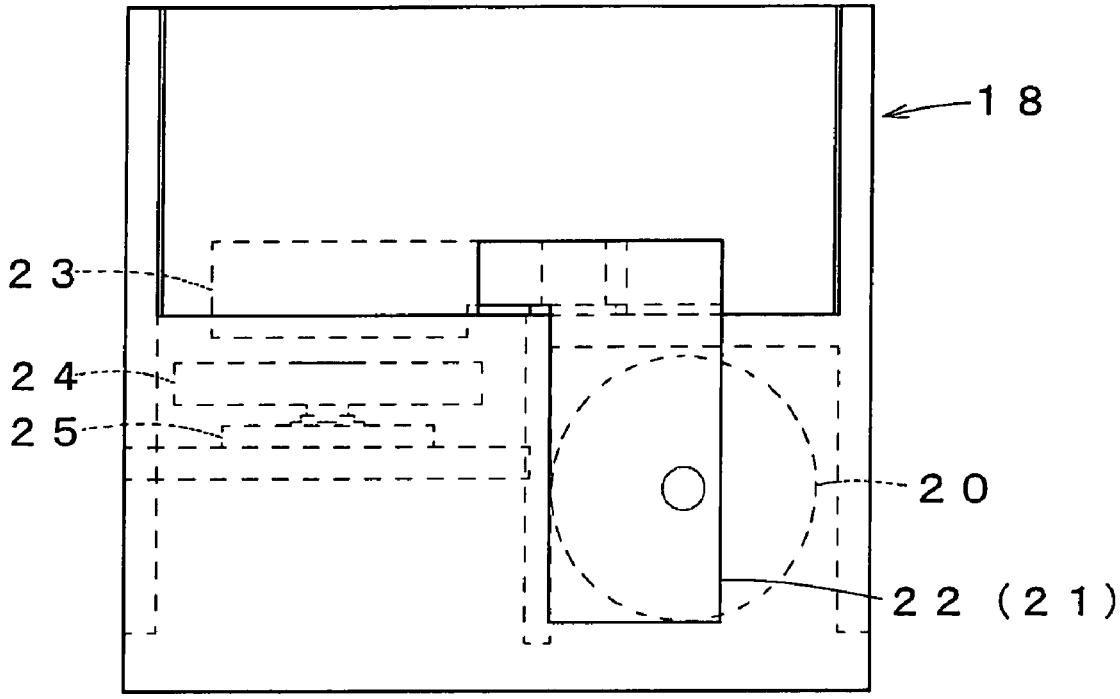
FIG. 8C is a plane view of FIG. 8B.
Figure 9A:
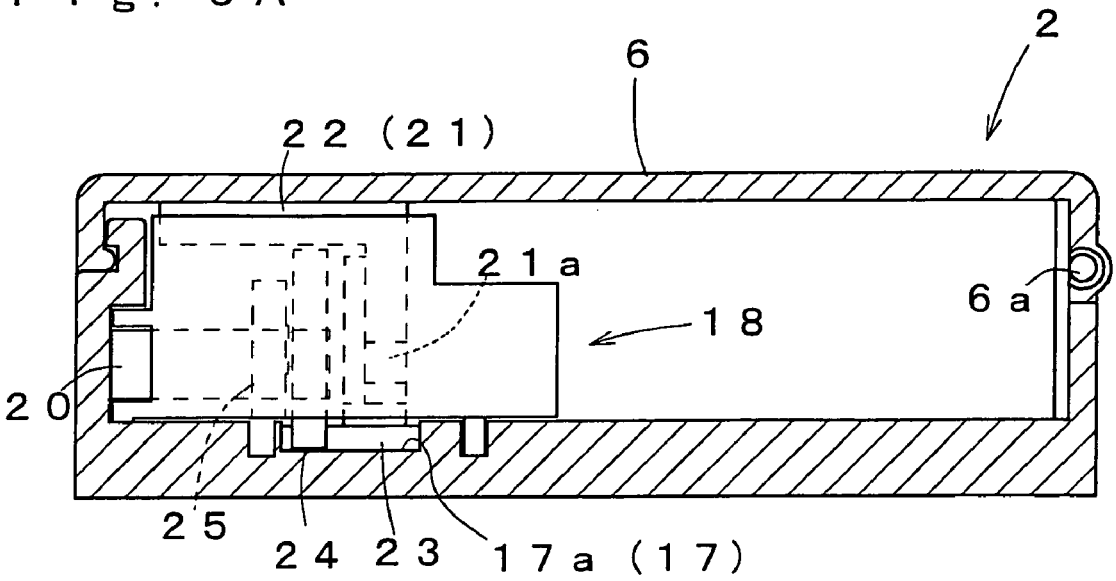
FIG. 9A is a cross sectional view showing the state that the cover of the cassette is closed.
Figure 9B:
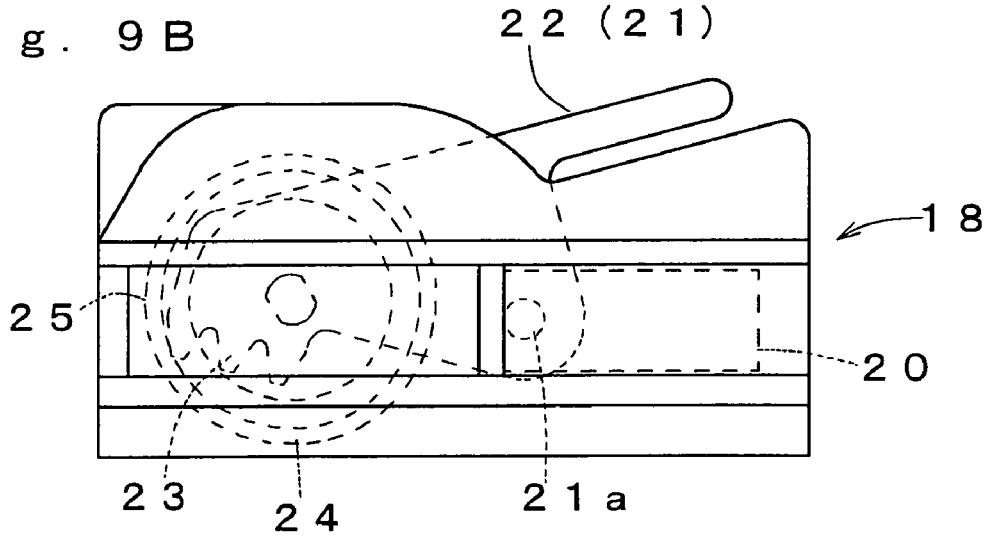
FIG. 9B is a side view showing the pushing unit.

On the inner bottom face of the cassette 2, a stopping rack 17 is formed in the longitudinal direction as shown in FIG. 6. The stopping rack 17 is composed of a plurality of vertically-long recess parts 17*a* provided at predetermined intervals in the longitudinal direction.

As shown in FIGS. 6 to 9, a push-out unit 18 as a push-out means is disposed in the cassette 2. The push-out unit 18 is composed of a constant-load spring 20 (equivalent of the biasing part) and a stopping member 21 (equivalent of the stopping part) which are housed in a casing 19. One end face of the casing 19 constitutes a pressing part 19*a*, which abuts against the medicine D contained in the cassette 2. The constant-load spring 20 is structured such that a portion of a spring part 20*a* housed in the casing is pulled out extendably outward, and the end of the pulled-out portion is connected to the rear side of the cassette 2. The stopping member 21 is provided rotatably around a spindle 21*a*, and an operation part 22 on one end thereof protrudes from the top face of the casing 19. The top face of the casing 19 partly forms an inclined plane 19*b* so as to conform to the lower face side of the operation part 22 of the stopping member 21 when it is pressed by the closed cover 6. Moreover, a gear part 23 is formed on the other end of the stopping member 21, which can engage with or disengage from each of the recess parts 17*a* in the stopping rack 17. The gear part 23 engages with the stopping rack 17 under its own weight (it goes without saying that the gear part 23 may be biased toward an engagement direction by biasing means such as springs). On the lateral side of the gear part 23, an oil damper 25 and an auxiliary gear 24 fixed onto its rotating shaft 25*a* are provided. The auxiliary gear 24 engages with each of the recess parts 17*a* in the stopping rack 17 like the stopping member 21, and receives load during rotation due to the work of the oil damper 25. Consequently, if the cover 6 is closed after the cassette 2 is charged with the medicines D, a failure that the push-out unit 18 rapidly moves and collides with the contained medicine D can be prevented from occurring. The push-out unit 18 has a detecting part (not shown) which can be detected by a remaining quantity detection sensor (not shown) provided in the vicinity of the rotor 5 in the stock shelf 3. This makes it possible to detect a low remaining quantity of the medicines D in the cassette 2, and to report it to users.

Figure 18:
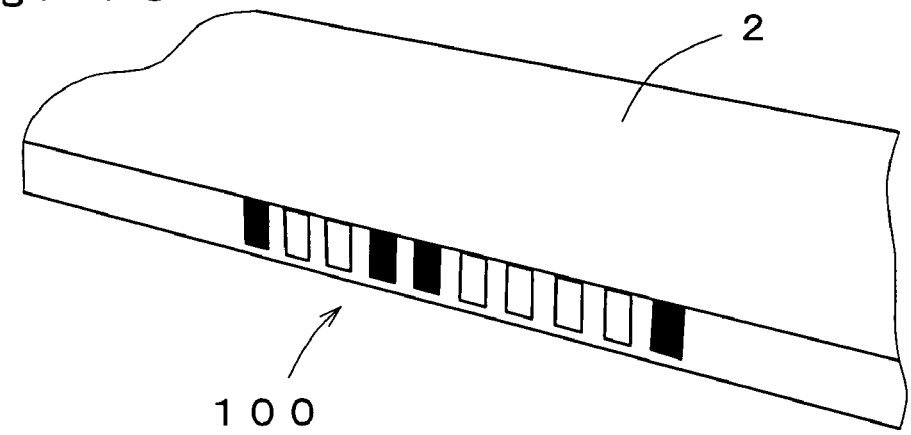
FIG. 18 is a perspective view showing an example of a detection target part provided on the side face of the cassette.

On the lateral face of the cassette 2 as shown in FIG. 18, there is provided a detecting part 100 composed of ten hollow or black rectangular frames arranged in a line. Two rectangular frames on both the ends are for detecting mounting of the cassette 2 on the stock shelf 3, whereas the other eight frames allow users to know the identification of the cassette 2 (eight frames support 28=256 types so that 240 cassettes 2 to be used herein can be fully supported). In this case, if a part of the detecting part 100 is used to reflect the difference in row or column and the remaining part is utilized to detect the number of the cassettes, then the operation for forming the detecting part 100 on the cassettes 2 can be simplified. Further, for detecting whether or not the cassette 2 is mounted on, both the hollow and black rectangular frames may be used by setting the first rectangular frame from the rotor 5 side to be hollow (presence) and the second rectangular frame to be black (absence). This setting prevents simultaneous detection of the first and the second rectangular frames during mounting of the cassette 2 on the stock shelf 3, which causes an erroneous determination that the cassette is present.

It is to be noted that reference numeral 26 denotes a guide which slidably comes into contact with a guide groove 27 formed in the longitudinal direction of the inner bottom face of the cassette 2 for stabilizing the operation of the push-out unit 18.

The dispensing unit 30, as shown in FIG. 2, rotates the rotor 5 through a driven gear 5*a* by the rotor drive member 31, discharges a medicine from the cassette 2 to a collecting lifter 47, and dispenses the medicine from a transportation conveyer unit 60 to the dispensing outlet 1*a* on the lower front side of the dispensing device body 1 through an delivery unit (not shown).

Figure 10:
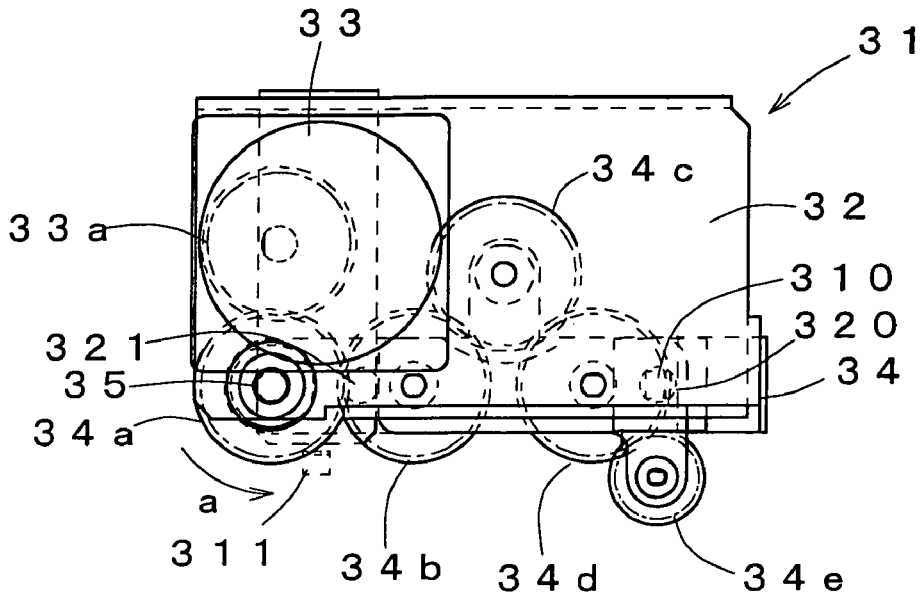
FIG. 10 is a side view at a retreat position of a rotor drive member.
Figure 11:
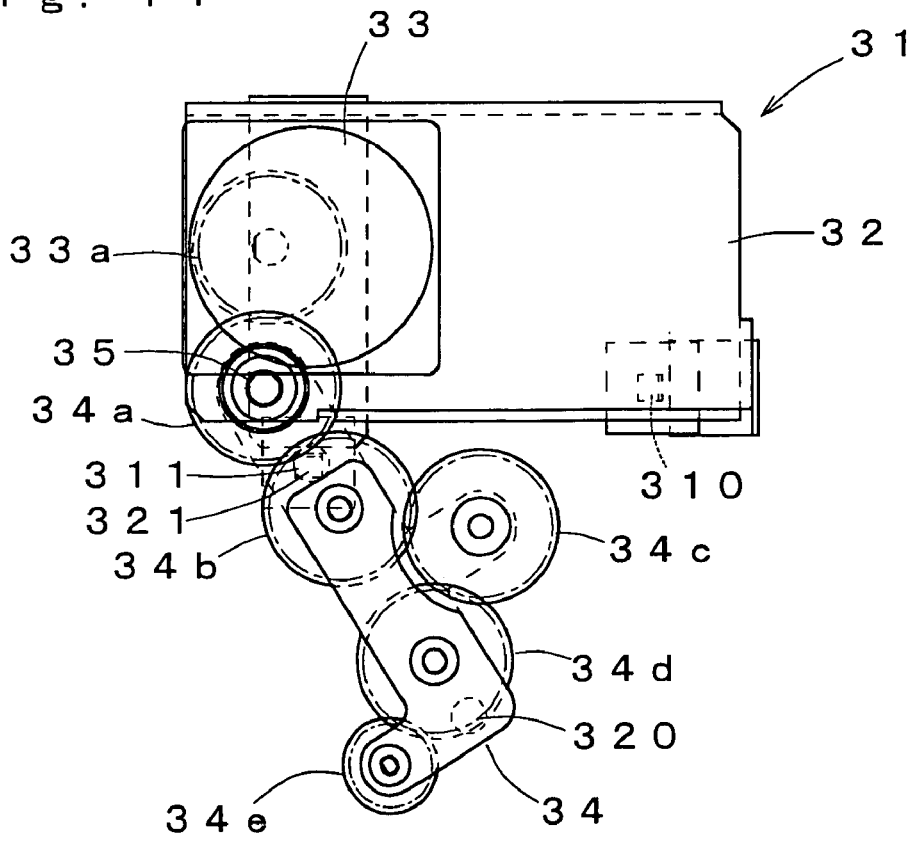
FIG. 11 is a side view at a standby position of the rotor drive member.
Figure 12:
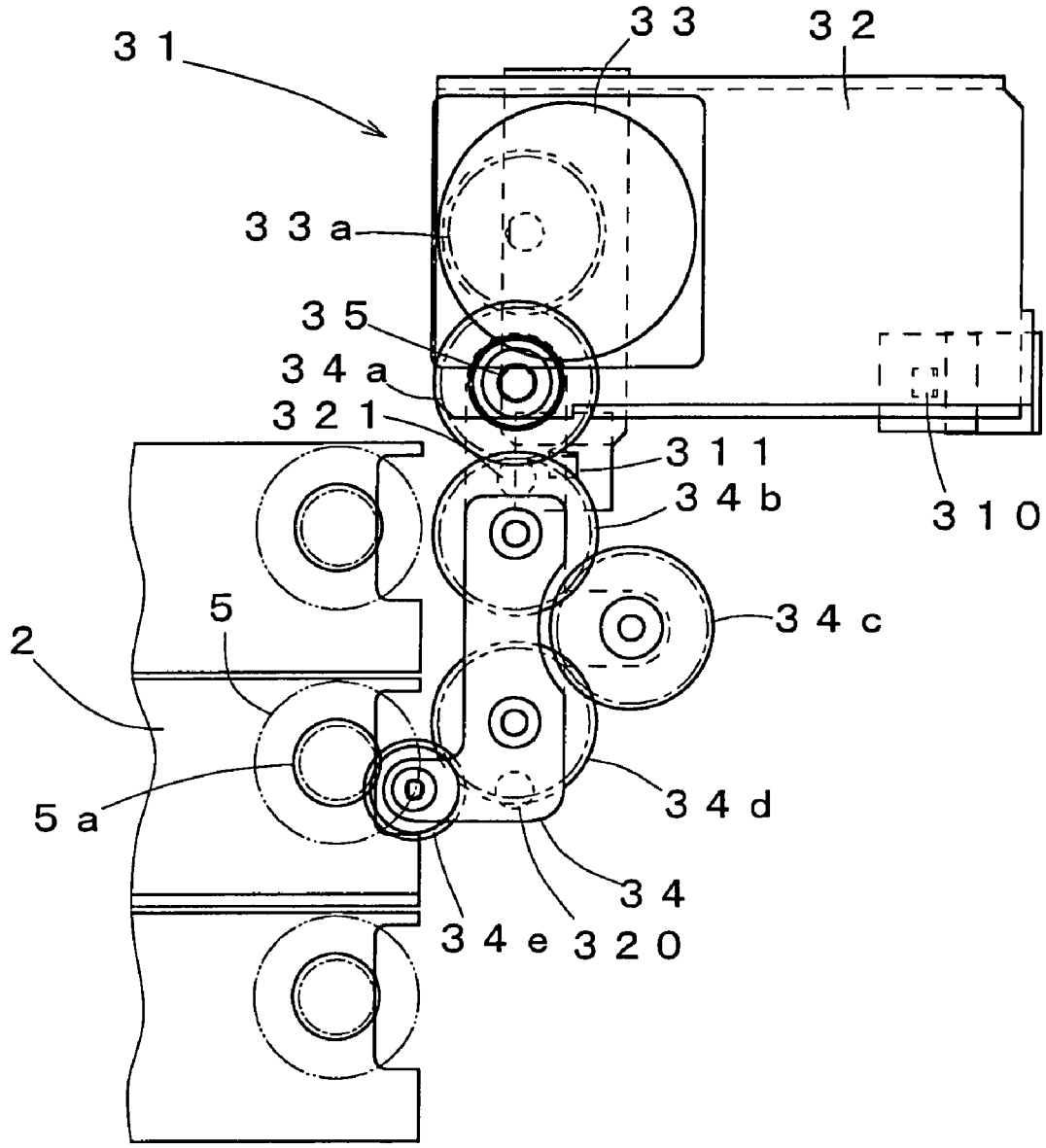
FIG. 12 is a side view at a drive position of the rotor drive member.

The rotor drive member 31 is structured such that, as shown in FIGS. 10 to 12, a drive motor 33 and a rotating plate 34 are provided on a guide plate 32 fixed onto the collecting lifter 47, and a power transmission gear 34*e* is rotated by a drive gear 33*a* provided on a rotating shaft of the drive motor 33 through intermediate gears 34*a*, 34*b*, 34*c*, 34*d* provided on the rotating plate 34. The rotating plate 34 is fixed together with the intermediate gear 34*a* onto the guide plate 32 rotatably around a spindle 35. Moreover, the intermediate gear 34*c* incorporates a one-way clutch which allows power transmission only when the drive motor 33 is reversely driven and rotated in one direction (rotated in a direction indicated by arrow a in FIG. 10), so that the rotating plate 34 can be rotated to a retreat position (FIG. 10) in almost the horizontal direction and to a standby position (FIG. 11) in an obliquely downward direction. Upon detection of a first magnet 320 provided on the rotating plate 34 by a sensor 310, the retreat position can be identified and the drive motor 33 can be stopped. Also, upon detection of a second magnet 321 provided on the rotating plate 34 by a sensor 311, the standby position can be identified and the drive motor 33 can be stopped. Further, in the case where the drive motor 33 is driven in the forward direction, power is not transmitted from the intermediate gear 34*c* to the rotating plate 34 and so the rotating plate 34 is positioned at a drive position (FIG. 12) in the vertical downward direction under its own weight (it can be biased by a spring). In this state, the power transmission gear 34*e* engages with the driven gear 5*a* of the rotor 5, and driving force of the drive motor 33 acts to rotate the driven gear 5*a* or the rotor 5 through the respective gears 32*a*, 34*a*, 34*b*, 34*c*, 34*d* and 34*e*. In this case, the power transmission gear 34*e* engages with the driven gear 5*a* of the rotor 5 on the lower side of the rotation center. Consequently, the rotation direction of the rotating plate 34 conforms to the direction of engagement with the driven gear 5*a*, so that the power transmission state is stabilized. Moreover, the rotating plate 34 itself can freely rotate, and so if the power transmission gear 34*e* does not properly engage with the gear 5*a* of the rotor 5, the proper engagement state can be earned by rotation of the rotating plate 34 and the resultant rotation of the power transmission gear 34*e*.

Figure 13:
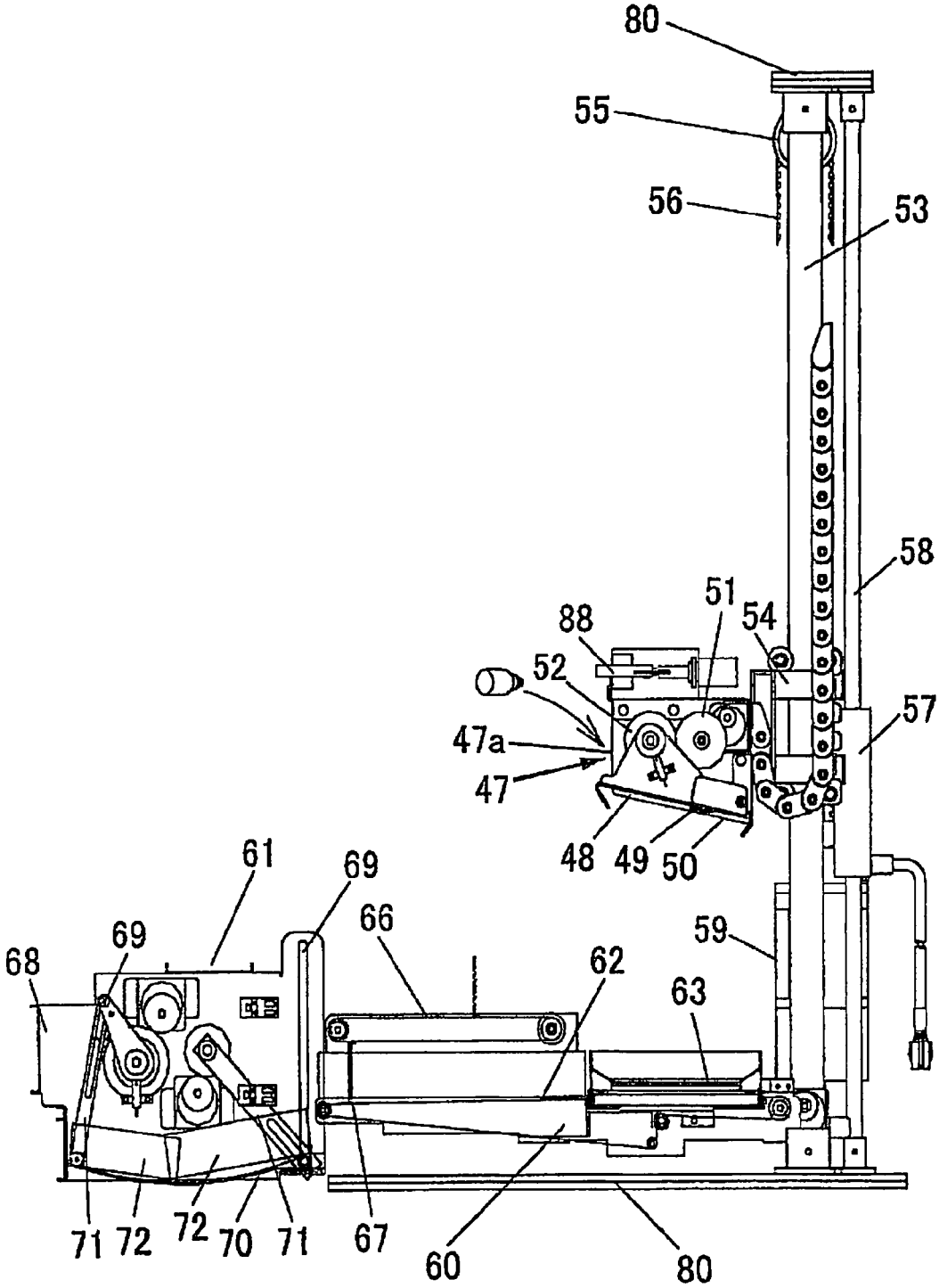
FIG. 13 is a front view showing a collecting lifter.

As shown in FIG. 13, the collecting lifter 47 has a lifter casing part 47*a* whose bottom face is composed of a bottom plate 48 and a fallout height absorber plate 50 which are rotatably linked to each other by a hinge 49 for collecting injection medicines dispensed from the cassette 2 through a rotor 5. The bottom plate 48 rotates through a gear 52 by driving of an open/close motor 51. Since the fallout height absorber plate 50 is linked to a free end edge part of the bottom plate 48 rotatably around the hinge 49 as described above, it rotates along the top face of the collecting conveyer 63. However, if the fallout height absorber plate 50 is constituted of a sponge, a brush or the like which itself has an elastic deformation property, the linkage by the hinge 49 is not necessary. Further, above the collecting lifter 47, a solenoid 88 is provided. The collecting lifter 47 is linked to a timing belt 56 hung over upper and lower pulleys through a lifting support part 54, and moves up and down along a guide rail 53 by driving of a lifting motor 59. It is to be noted that reference numeral 57 denotes a weight for achieving weight balance against the collecting lifter 47.

Figure 14:
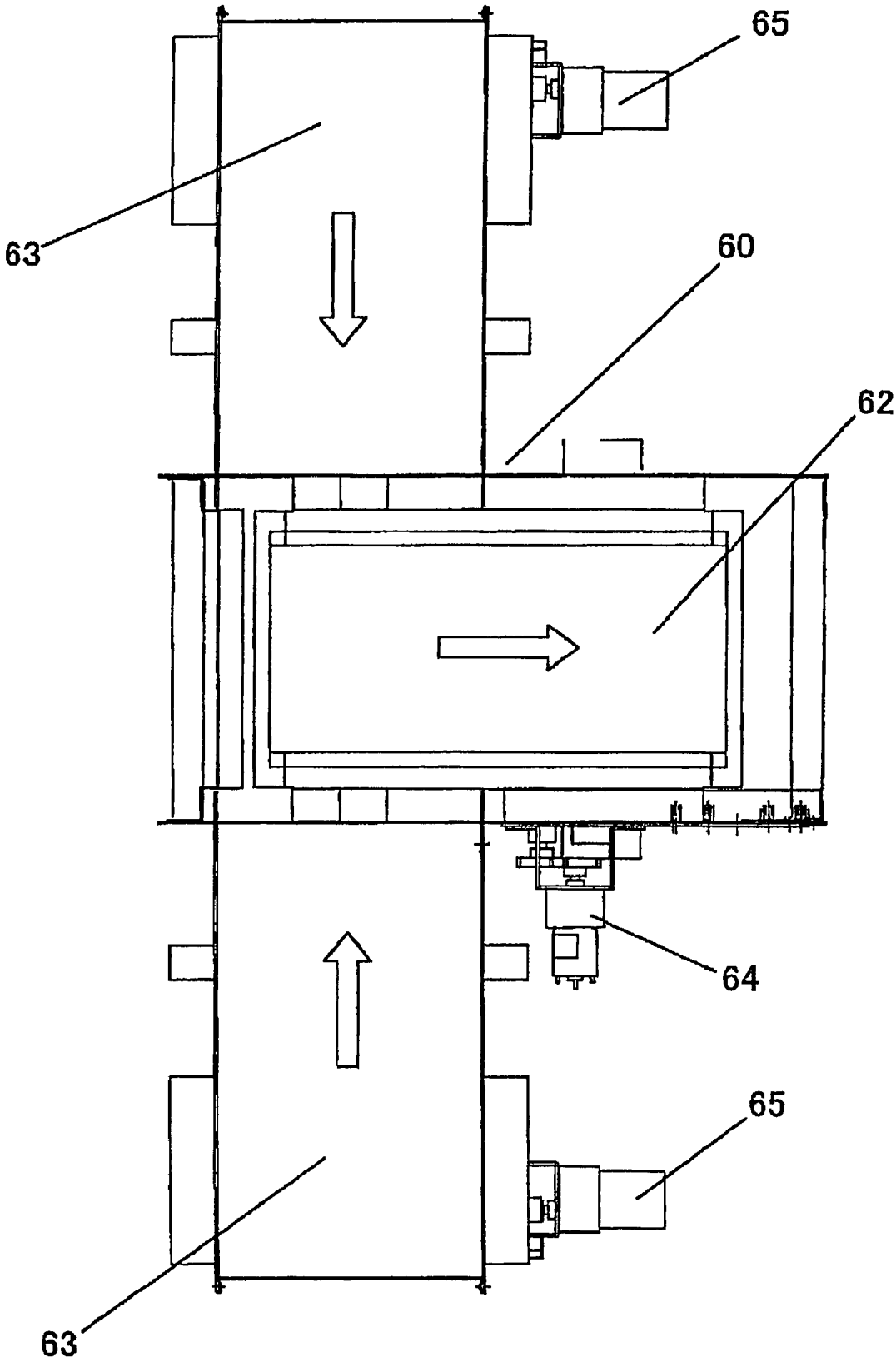
FIG. 14 is a plane view showing a transportation conveyer unit.

Below the collecting lifter 47, a transportation conveyer unit 60 is disposed. The transportation conveyer unit 60 has a collecting conveyer 63 and a center conveyer 62. The collecting conveyer 63 is driven by a collecting conveyer drive motor 65 for transporting injection medicines to the center conveyer 62. By driving of a motor (not shown), the center conveyer 62 further transports the injection medicines transported from the collecting conveyer 63 to a transfer unit 61. Above the center conveyer 62, a force shutter belt 66 and a force shutter 67 rotating together with the force shutter belt 66 are provided. It is to be noted that the arrangement of the collecting conveyer 63 and the center conveyer 62 in the transportation conveyer unit 60 is as shown in FIG. 14.

Figure 15:
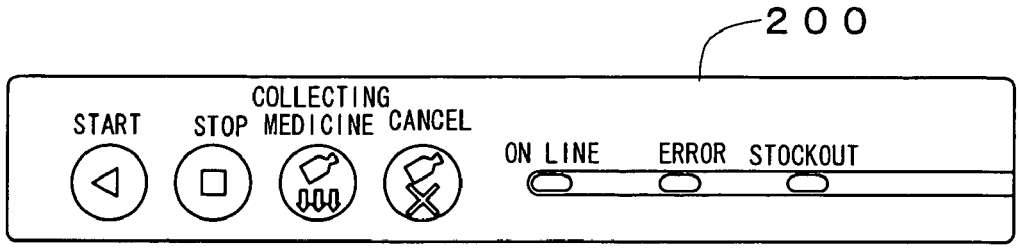
FIG. 15 is a front view showing an operation panel provided on the front face of the dispensing device body.
Figure 16:
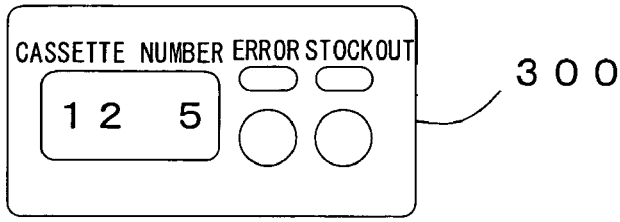
FIG. 16 is a front view showing a display panel provided on the front face of the dispensing device body.

As shown in FIG. 17, in the device for dispensing medicine, a display part 8 carrying contained medicine number, medicine name and capacity is provided on the front face of each cassette 2. Moreover, an operation panel 200 and display panels 300 disposed for each column of the cassettes 2 are provided on the front upper portion of the dispensing device body 1. The operation panel 200 has, as shown in FIG. 15, a start button, a stop button, a medicine collecting button and a cancel button, as well as LEDs each indicating Online, Error and Stock-Out. As shown in FIG. 16, the display panel 300 carries a cassette No., an error LED and a Stock-Out LED. When the Online LED is lit on the operation panel 200, operation is available. When a cassette 2 is short of medicines and stock-out error occurs, its Stock-Out LED is lit in green color, while on the display panel 300, the cassette No. is carried and the Stock-Out LED is lit. This notifies the relevant column in one glance and makes it easy to identify the cassette in need of attention. For continuing dispensing operation of other medicines, the Stock-Out error can be cancelled, and the Stock-Out LEDs on the respective panels 200 and 300 as well as the cassette No. on the display panel 300 are changed to be in the state of blinking in green color. Further, if error occurs in a cassette 2 itself, then the error LEDs on the respective panels 200 and 300 are lit in red color while at the same time, the cassette No. on the display panel 300 blinks in red color. Further, if a cassette 2 is not yet mounted, the Stock-Out LEDs on the respective panels 200 and 300 are lit in green color, and the cassette No. on the display panel 300 are lit in green color.

Description is now given of the operation of the above-constituted device for dispensing medicine.

When medicines D are supplied to a cassette 2, the cassette 2 is dismounted from the stock shelf 3 of the dispensing device body 1. In this case, the stopper cancel member 13 is protruded in the horizontal direction by biasing force from the spring 14, by which the stopper 10 is rotated in the horizontal direction. Consequently, the medicines D in the cassette 2 are prevented from falling out by the fallout prevention part 12 in the stopper 10. Once the cover 6 of the cassette 2 is opened, the rotor 21 is rotated and its gear part 23 engages with the recess parts 17*a* of the stopping rack 17. However, with the rotor 21 being in a rotatable state, if the push-out unit 18 is moved to the rear end side against the biasing force from the constant-load spring 20, the gear part 23 of the rotor 21 disengages from the recess parts 17*a* in the stopping rack 17, so as to prevent the movement to be hindered. Once the medicines D are contained and the cover 6 is closed, the rotor 21 rotates through the operation part 22 and the engagement state between the gear part 23 and the stopping rack 17 is cancelled. In this case, if an interval is present between the push-out unit 18 and the medicine D, the push-out unit 18 slowly comes near the medicine D with the function of the oil damper 25 linked to the auxiliary gear 24 and engages the medicine D without damaging it. Once the cassette 2 is housed in the stock shelf 3 in the dispensing device body 1, the stopper cancel member 13 pushes the contact piece 13*a* with the protrusion 4, by which the stopper 10 rotates in the obliquely downward direction to prepare the medicine D to be discharged. In this state, the medicine D abuts against the outer circumferential plane 5*c* of the rotor 5.

At this point of time, if prescription data is inputted from an a host computer (not shown) or the like, the collecting lifter 47 moves to the cassette 2 containing a pertinent medicine D based on the prescription data, and the dispensing unit 30 is driven to rotate the rotor 5 in the stock shelf 3. More particularly, the drive motor 33 is driven to rotate the rotor 5 through the gears 32*a*, 34*a*, 34*b*, 34*c*, 34*d*, 34*e*, 5*a*. As a result, the medicines D in the cassette 2 are dispensed in sequence one by one. The dispensed medicine D is collected by the collecting lifter 47 and transferred to the transportation conveyer unit 60, before being dispensed to the dispensing outlet 1*a* on the lower front face of the dispensing device body 1 through an transfer unit (not shown).

Figure 19:
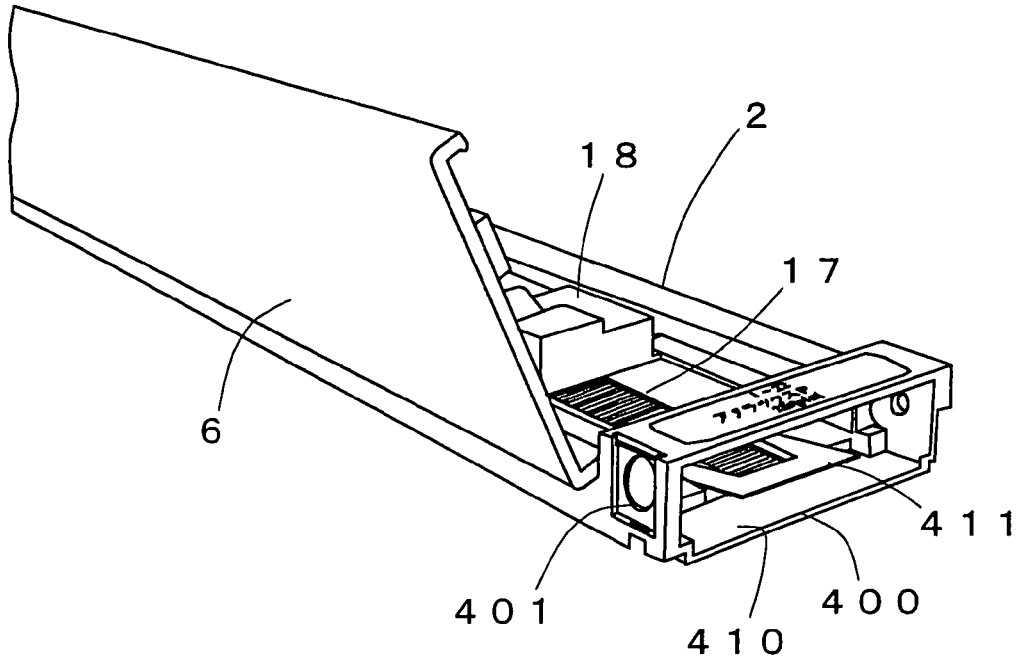
FIG. 19 is a perspective view showing the cassette in the state before a rotor is mounted as viewed from the back face side according to another embodiment.
Figure 20:
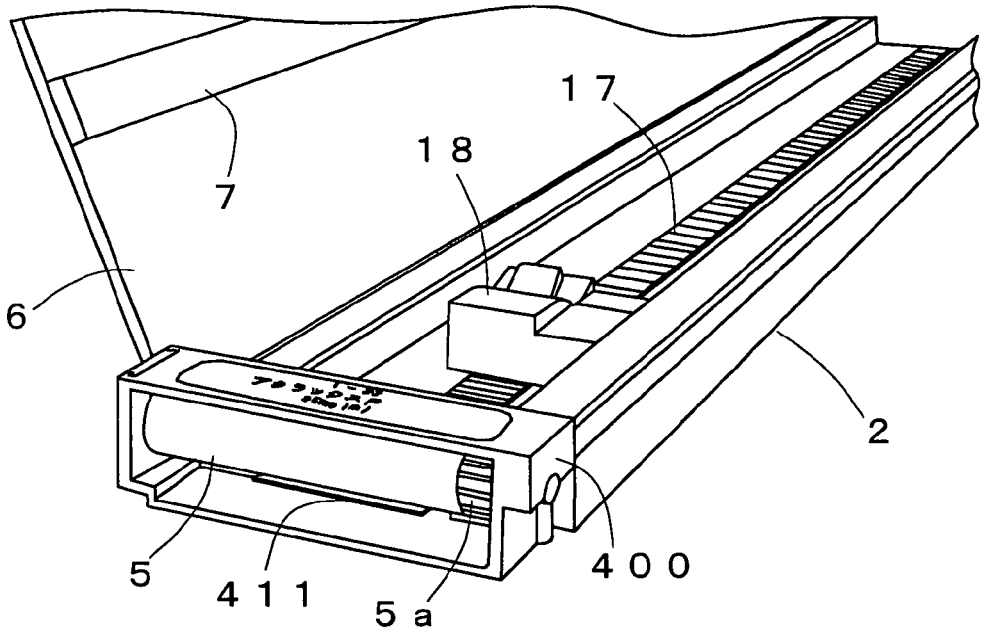
FIG. 20 is a perspective view showing the cassette in the state before the rotor is mounted as viewed from the back face side according to another embodiment.
Figure 21:
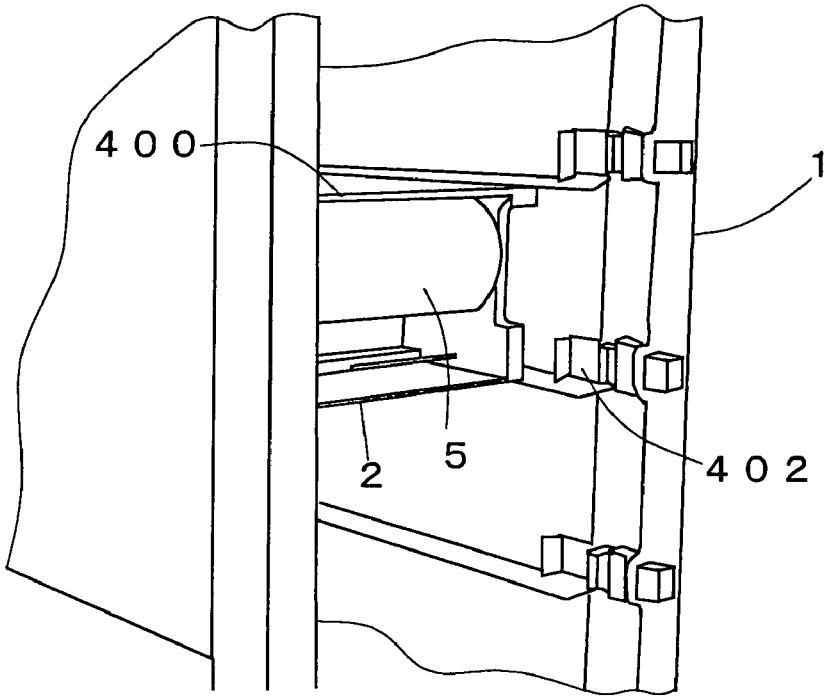
FIG. 21 is a perspective view showing the cassette mounted on a stock shelf as viewed from the back face side of the dispensing device body according to another embodiment.
Figure 22:
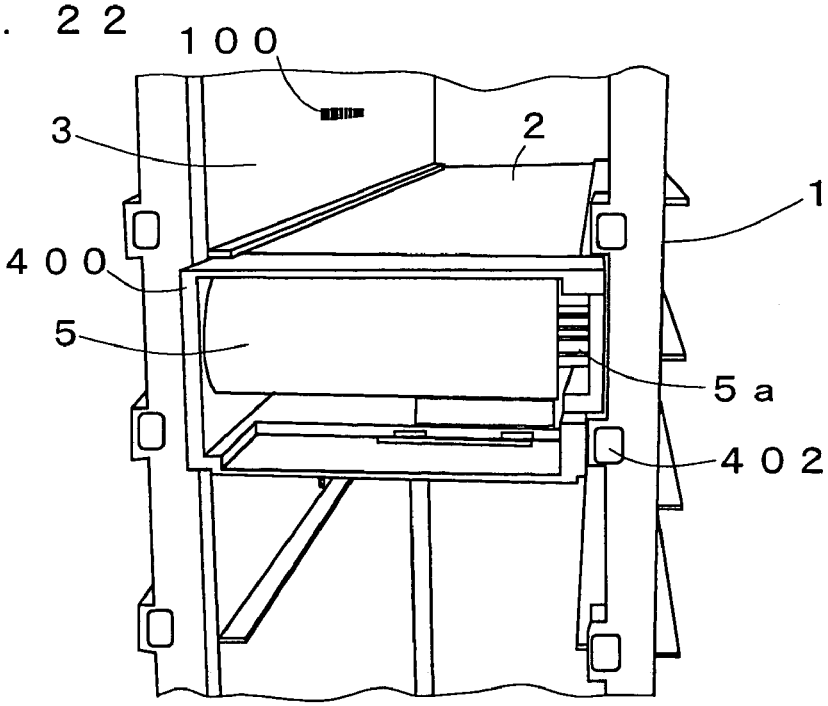
FIG. 22 is a perspective view showing the cassette as viewed from an angle different from that of FIG. 21.

It is to be noted that although the rotor 5 is provided on the side of the each stock shelf 3 of the dispensing device body 1 in the embodiment, the rotor 5 may be structured so as to be integrated with the cassette 2 as shown in FIG. 19 and FIG. 20. More particularly, a rotor mounting part 400 may be formed on the rear end side of the cassette 2, and the rotor 5 may be rotatably mounted through a through hole 401 formed on its lateral side. As described before, the center of rotation of the rotor 5 is positioned above the center of a discharge route of medicines, and the circular plane 5*b* is in the shape which allows dispensing of only one medicine D even if the medicine D has a maximum outer diameter and which prevents interference with the next medicine D. Further, the bottom face of the rotor mounting part 400 serves as an escape part 410 positioned below the bottom face of the cassette 2. From both sides of the stopping rack 17, a plate spring 411 is extensively provided.

The plate spring 411 comes into tight contact with a head medicine received by the circular plane 5*b* of the rotor 5 to prevent the medicine D from falling out. The plate spring 411 comes into tight contact with the medicine D so that the medicine D can be retained by the circular plane 5*b* of the rotor 5 even if the medicine D has a smaller outer diameter. Further, with the medicine D with a largest outer diameter, the plate spring 411 is elastically deformed so as to be within the escape part 410, by which the medicine D can be dispensed by the rotor 5. This allows the rotors 5 of the same shape to be used in any cassettes 2 which respectively contain medicines D that are different in outer diameter size.

Figure 25A:
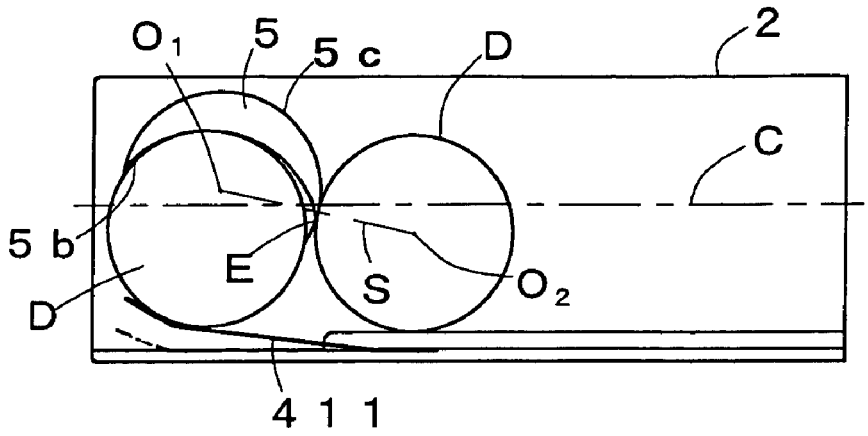
FIGS. 25A to 25C are cross sectional views showing the cassette according to another embodiment.

The end of the plate spring 411 should preferably be curved upward at a predetermined angle as shown in FIG. 25A. This allows more effective prevention of the medicines D contained in the cassette 2 from improperly popping out. In this case, what is necessary is to impart elasticity to the medicines D so that an edge E of the circular plane 5*b* of the rotor 5 is not positioned above a straight line S connecting the center of rotation O1 of the rotor 5 and the center O2 of the next medicine D by the end curved portion of the plate spring 411. Consequently, even if the rotor 5 rotates, the next medicine D is not pushed back by its outer circumferential plane 5*c* and so is free from influence of unnecessary load, thereby enabling the rotor 5 to smoothly rotate.

Figure 25B:
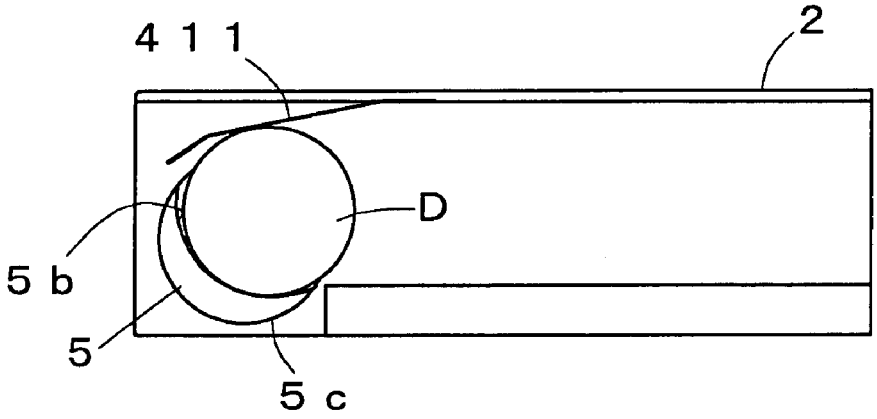

Moreover, the plate spring 411 may be provided on the ceiling face as shown in FIG. 25B instead of the bottom face of the cassette 2. In this case, the rotor 5 should be rotated in the reverse direction (counterclockwise in FIG. 25B).

Figure 25C:
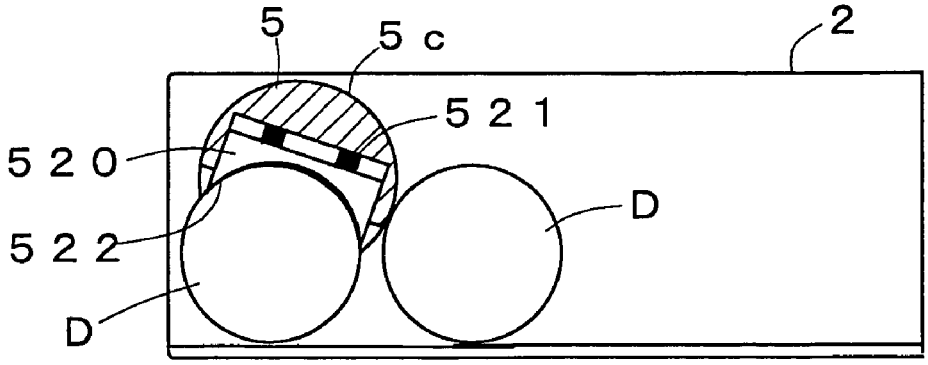
Figure 25D:
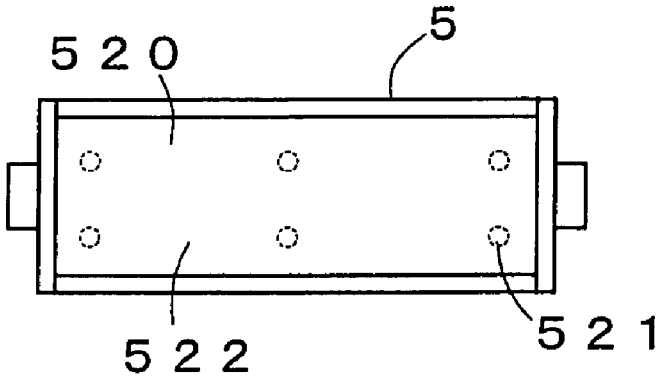
FIG. 25D is a front view showing a pressing member of a rotor of FIG. 25C.
Figure 25E:
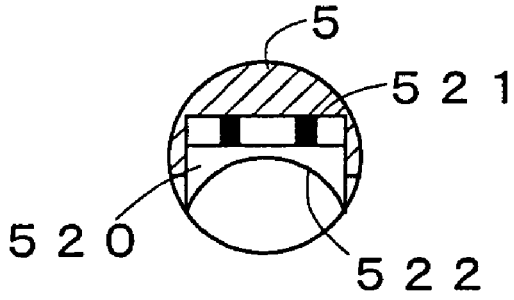
FIG. 25E is a front view showing an initial position of the rotor of FIG. 25C.
Figure 25F:
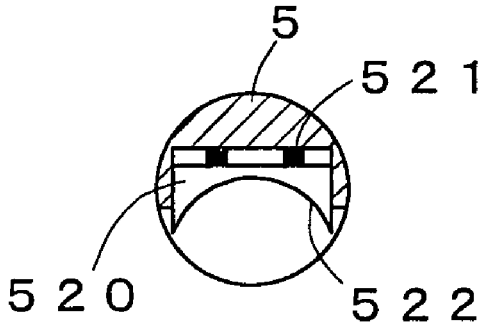
FIG. 25F is a cross sectional view showing an inserting position of the rotor of FIG. 25C.

Further, instead of using the plate spring 411, a part of the rotor 5 including the circular plane 5*b* may be constituted of a pressing member 520, as shown in FIG. 25C, which is elastically supported in such a way as to be pushed down, so that the different size of the medicine D can be supported. In this case, as shown in FIG. 25D, the pressing member 520 is elastically supported in such a way as to be pushed down by a spring 521 provided at six places from an initial position shown in FIG. 25E to a pushed position shown in FIG. 25F.

Figure 23:
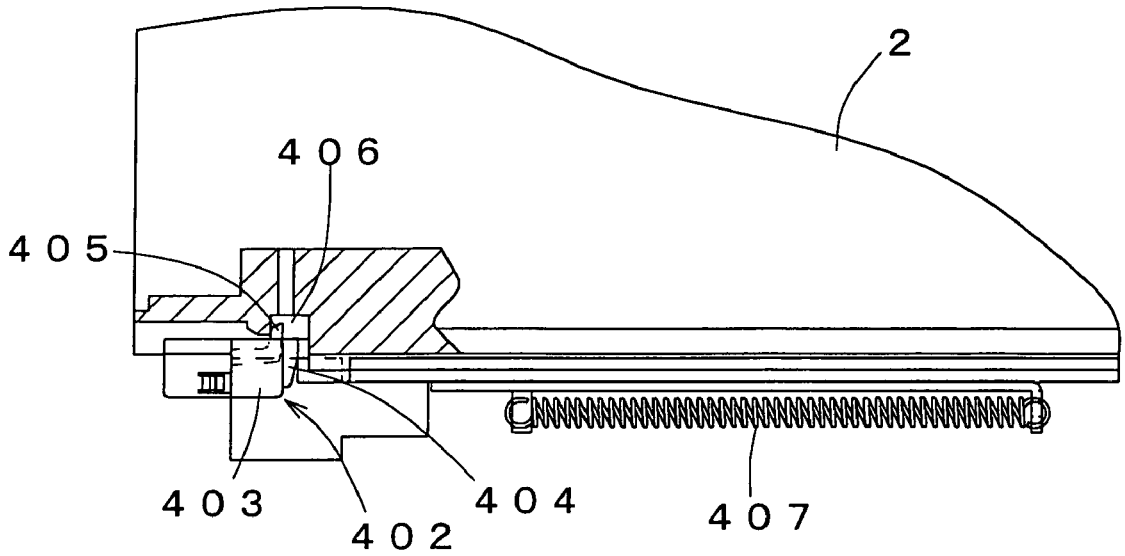
FIG. 23 is a fragmentary plane view showing the cassette in the state before being mounted on the stock shelf according to another embodiment.
Figure 24:
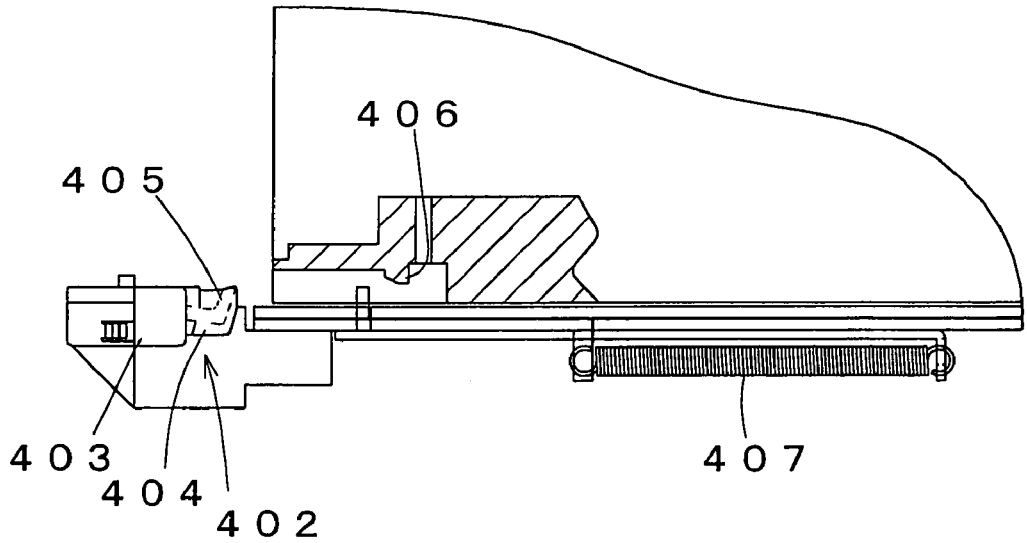
FIG. 24 is a fragmentary plane view showing the cassette in the state after being mounted on the stock shelf according to another embodiment.

Moreover, the stopping part 9 provided on the cassette 2 may be replaced with a stopping member 402 provided on the side of the stock shelf 3 as shown in FIGS. 21 to 24. In this case, as shown in FIG. 23 and FIG. 24, a stopping recess part 406 should be formed on the lateral face of the cassette 2 and a stopping member 402 should be disposed on the side of the stock shelf 3. As the stopping member 402, a component constituted so as to have a stopping part 405 which pushes a push part 404 to the side of a body 403 and protrudes to the lateral side upon mounting of the cassette 2 on the stock shelf 3 may be used. In the first pushing operation, the stopping member 402 protrudes the stopping part 405 to the lateral side and in the second pushing operation, the stopping member 402 buries the stopping part into the push part 404. It is to be noted that reference numeral 407 denotes a spring, and its one end portion is stopped by a stopping piece protruding from the bottom face of the resonator 3 while the other end potion is stopped by one end portion of a rod provided slidably on the bottom face of the resonator 3. When the cassette 2 is dismounted from the stock shelf 3, once the stopping state by the stopping member 402 is cancelled, the biasing force of the spring 407 acts through the rod so as to protrude the cassette 2 from the front face of the dispensing device body 1. The biasing force of the spring (wire diameter, winding number, length, etc.) is determined in consideration of the size and the weight of the cassette 2 contained in the stock shelf 3 or the protruding size of the cassette 2 from the stock shelf 3 and the like.

Figure 26A:
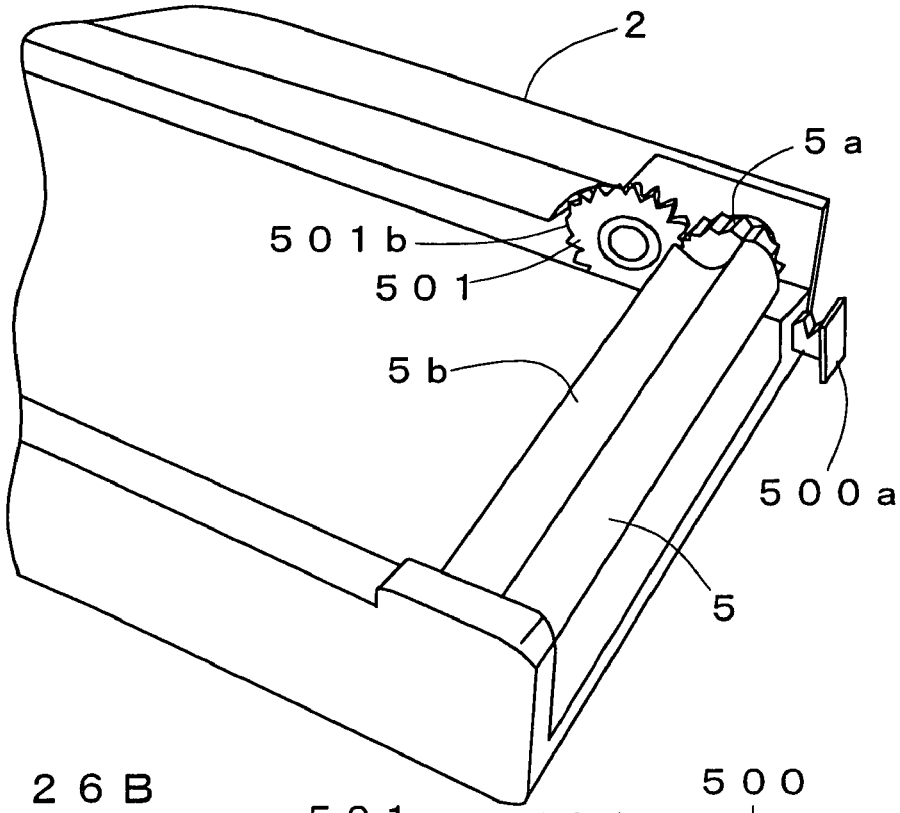
FIG. 26A is a fragmentary perspective view showing a cassette according to another embodiment.
Figure 26B:
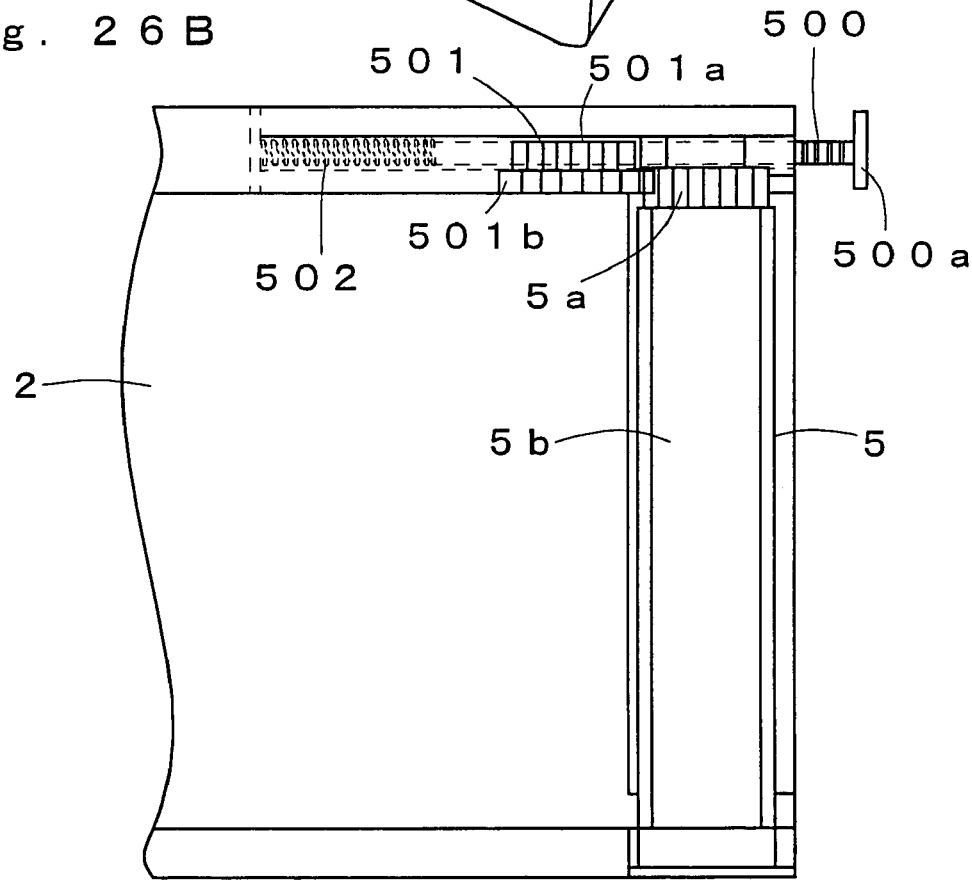
FIG. 26B is a plane view of FIG. 26A.

Further, as shown in FIG. 26, the gear 5*a* provided on the rotor 5 may be engaged with a major diameter gear 501*b* of an intermediate gear 501, its minor gear 501*a* may be engaged with a rack gear 500, and the rack gear 500 may be reciprocated so as to rotate the rotor 5 in the reciprocal direction. On one end portion of the rack gear 500, a pressure receiving piece 500*a* for allowing easy pressing is provided. Further, on the other end of the rack gear 500, a spring 502 is disposed so that the rack gear 500 is biased in a protruding direction from the cassette 2. Herein, the number of teeth of the major diameter gear 501*b* of the intermediate gear 501 is set at 20, whereas the number of teeth of the minor gear 501*a* is set at 14. Consequently, only by setting the amount of the rack gear 500 at 16 mm, the rotor 5 can be rotated 240 degrees, i.e., the rotor 5 can be rotated through desired angles with a short stroke.

Figure 27A:
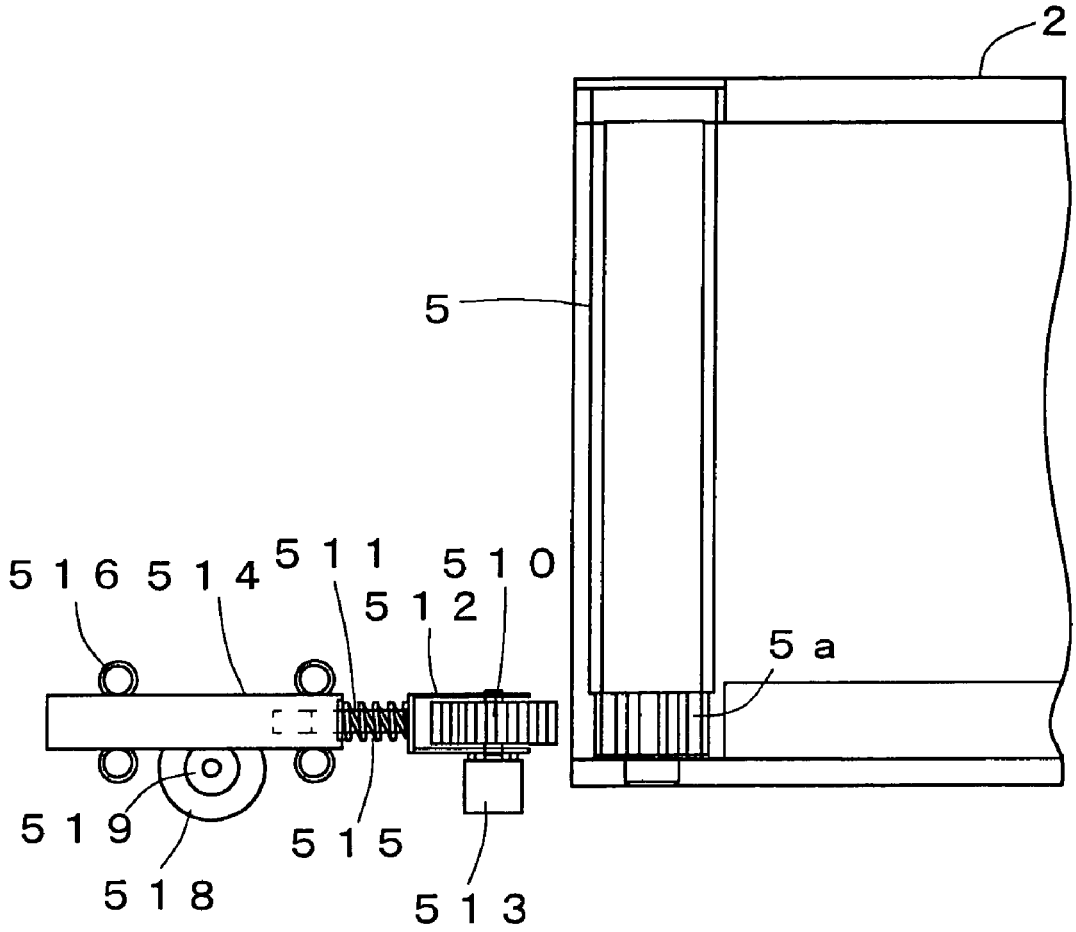
FIG. 27A is a fragmentary plane view showing the cassette according to another embodiment.
Figure 27B:
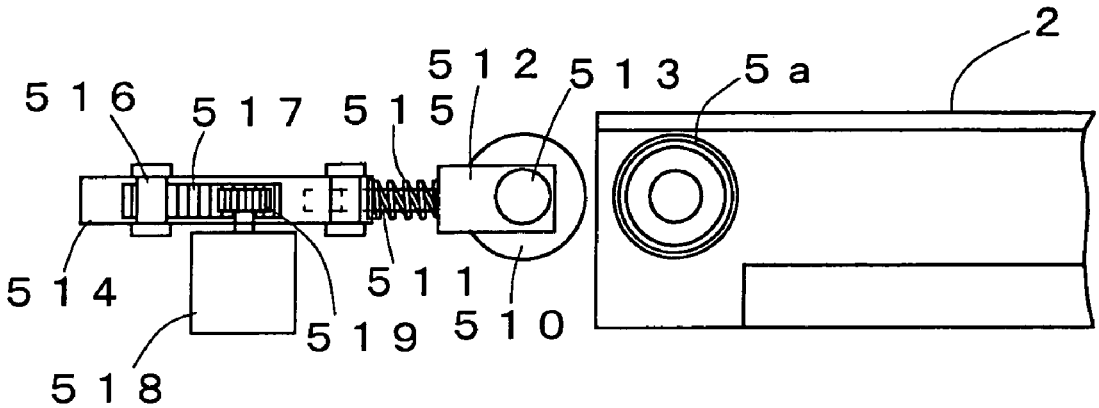
FIG. 27B is a cross sectional side view of FIG. 27A.
Figure 27C:
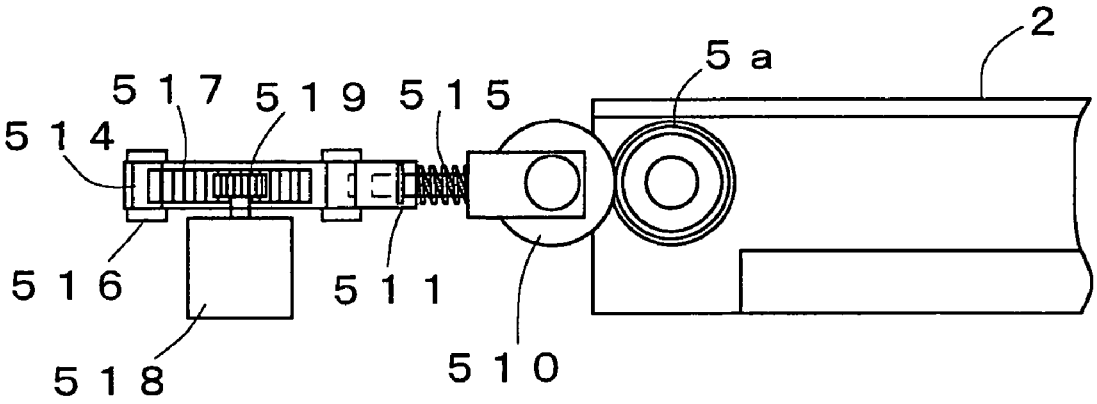
FIG. 27C is a cross sectional side view showing an operation state.

Moreover, the gear 5*a* provided on the rotor 5 may be engaged with a first gear 510 which operates in such a way as to come into contact or break away as shown in FIG. 27A. The first gear 510 is supported by a support piece 512 formed in laterally-positioned U shape which is provided on the end of a rod 511, and is rotated by driving of a motor 513 fixed to the support piece 512. The rod is attached to the end of a support body 514 in the state of being biased in the protruding direction by a spring 515. The support body 514 is guided at four places on its lateral faces by rotatable rollers 516 so as to be able to reciprocate. On the lateral face of the support body 514, a rack 517 is formed, and the rack 517 is engaged with a second gear 519 provided on a rotating shaft of a forward/backward driving motor 518. When the forward/backward driving motor 518 is driven, the support body 514 moves forward and backward through the second gear 519 and the rack 517 as shown in FIG. 27B and FIG. 27C, and the first gear 510 comes into contact with or breaks away from the gear 5*a* of the rotor 5.

Figure 28A:
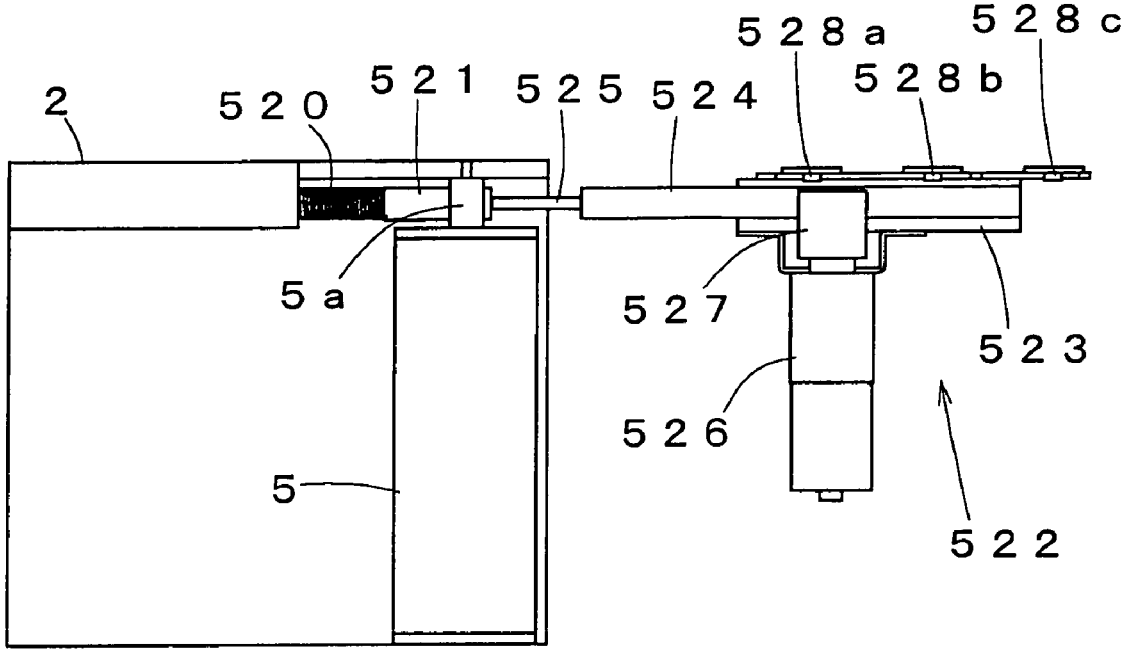
FIG. 28A is a plane view showing a cassette according to another embodiment.
Figure 28B:
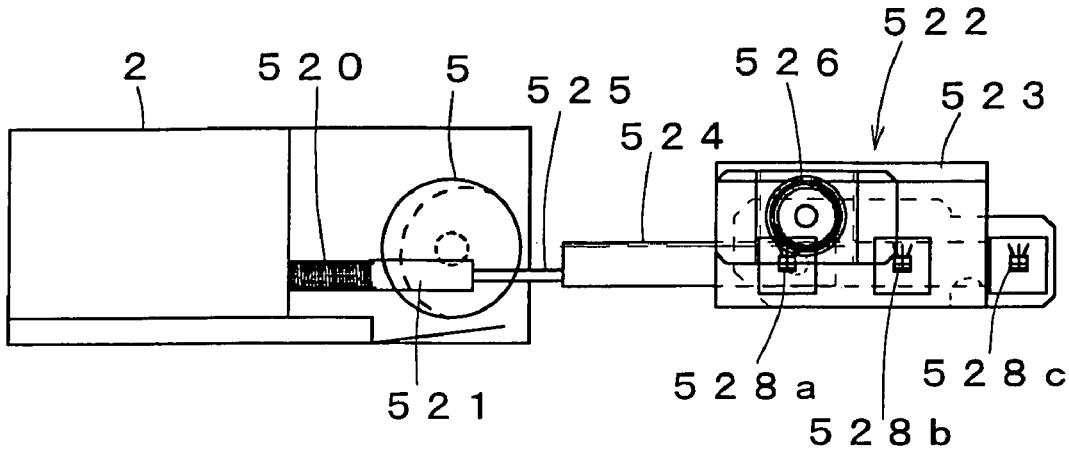
FIG. 28B is a side view of FIG. 28B showing a protruding position.
Figure 28C:
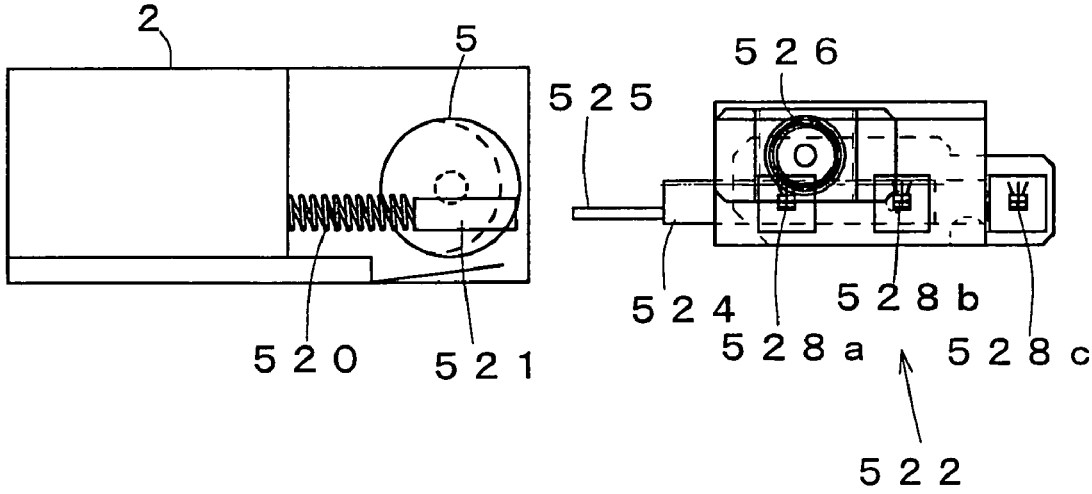
FIG. 28C is a side view of FIG. 28A showing a standby position.

Further, as shown in FIG. 28A, the gear 5*a* provided on the rotor 5 may be engaged with a rack gear 521 biased in the protruding direction by a spring 520, and the rotor 5 may be rotated by pressing an end portion of the rack gear with a pusher 522. The pusher 522 is structured such that a rack gear 524 is slidably disposed on the pusher body 523 and a pusher rod 525 is fixed onto the end of the rack gear 524. The rack gear 524 is engaged with a drive gear 527 integrated with a rotating shaft of a motor 526, and is slid by driving of the motor 526. Sensors 528*a*, 528*b*, 528C provided at three places on the rack gear 524 detect a protruding position at which the rack gear 521 is pushed by the pusher rod 525 (see FIG. 28A and FIG. 28B), a standby position before the pusher rod 525 is protruded (see FIG. 28C), and an avoiding position for avoiding interference with the bottom plate 48 when the bottom plate 48 of the collecting lifter 47 is opened.

Figure 29:
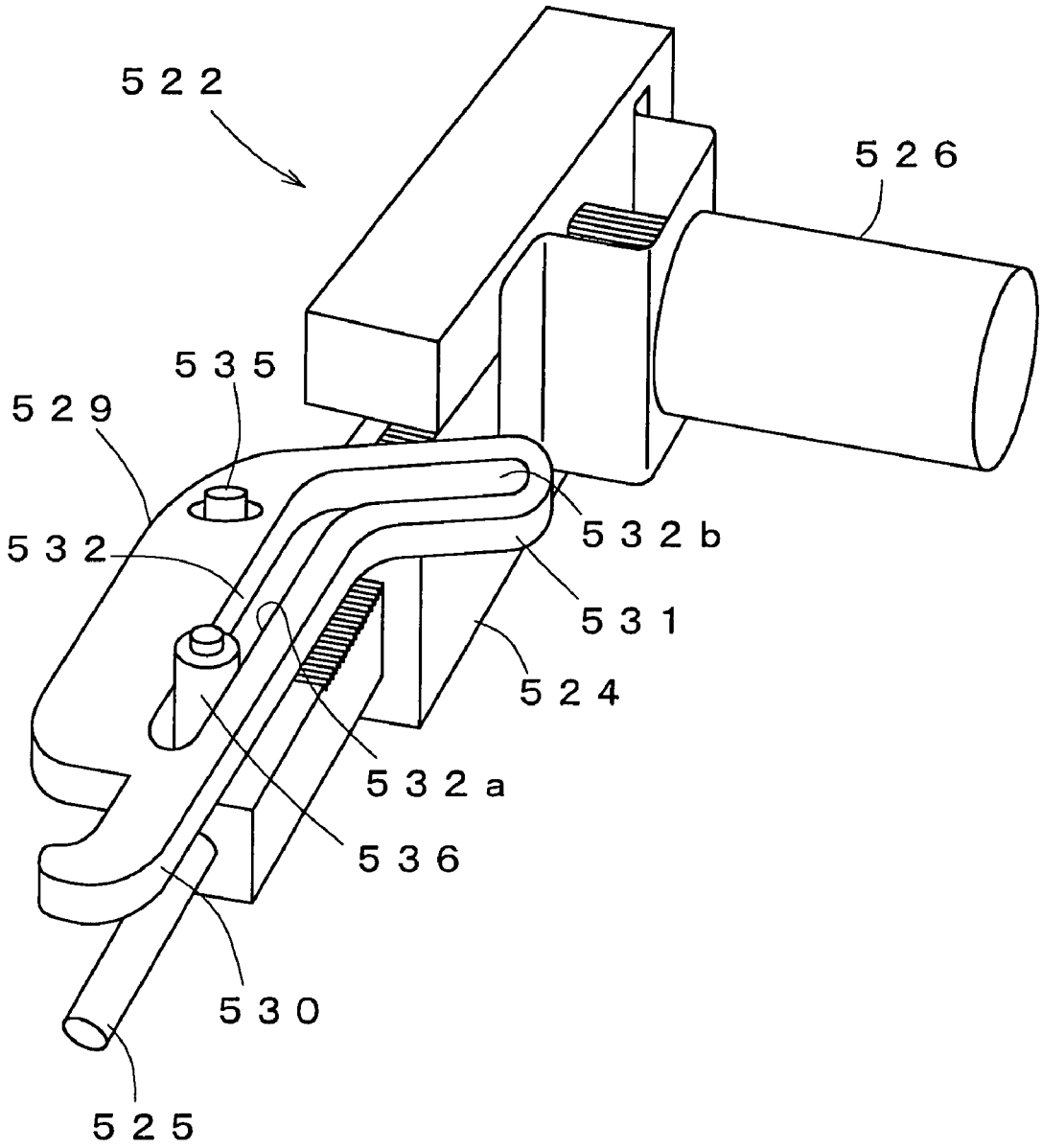
FIG. 29 is a perspective view showing a pusher according to another embodiment.

Further, as shown in FIG. 29, the pusher 522 may be constituted to have a stopping/retaining member 529. The stopping/retaining member 529 is in a plate-like shape, and a stopping hook part 530 is protruded on its one end side. The stopping hook part 530 is narrower than the stopping/retaining member 529. The end of the stopping hook part 530 is curved toward the lateral direction, and is engaged with a stopping hole 2*b* formed on the rear lateral face of the cassette 2. Moreover, the stopping/retaining member 529 has an inclined piece 531 extensively provided on the other end side, the inclined piece 531 being inclined gradually toward the end. Further, the stopping/retaining member 529 has a long hole 532 formed along a lateral edge portion from the inclined piece 531 toward the vicinity of the stopping hook part 530.

Figure 30A:
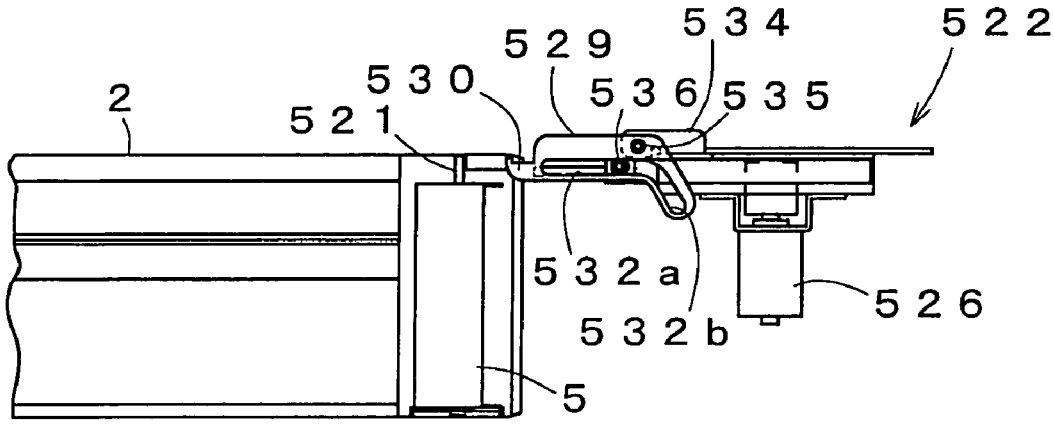
FIG. 30A is a fragmentary plane view showing the state that a stopping/retaining member of a pusher shown in FIG. 29 is rotated to the protruding position.
Figure 30B:
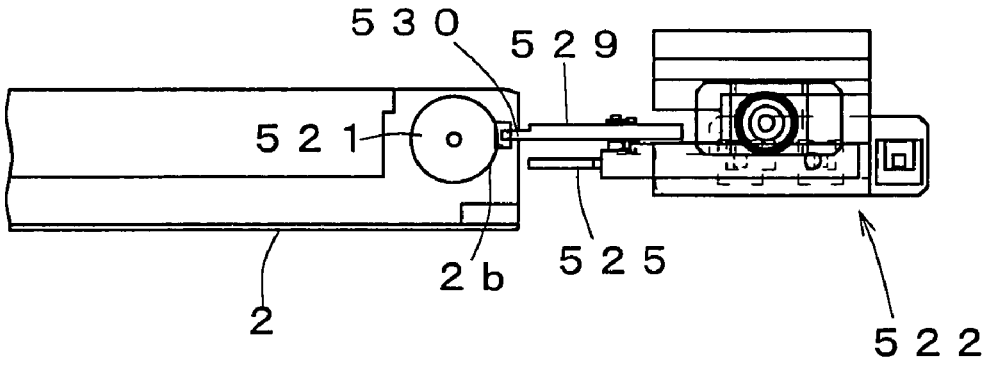
FIG. 30B is a front view of FIG. 30A.
Figure 32A:
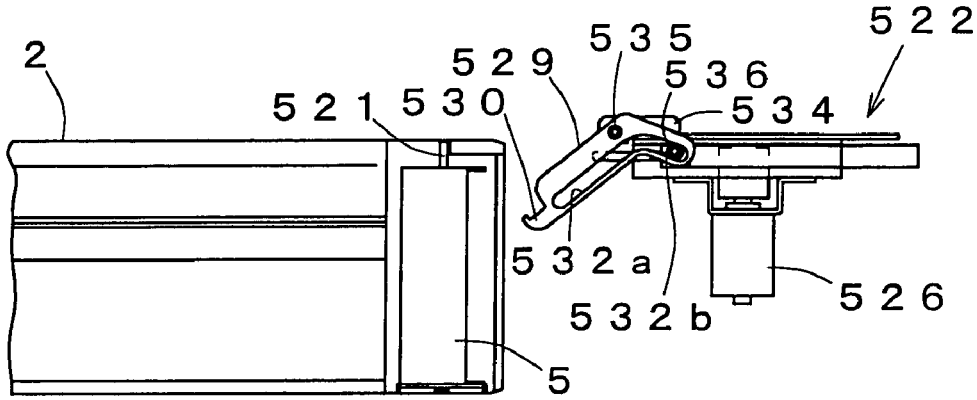
FIG. 32A is a fragmentary plane view showing the state that the stopping/retaining member of the pusher shown in FIG. 29 is rotated to the retreat position.
Figure 32B:
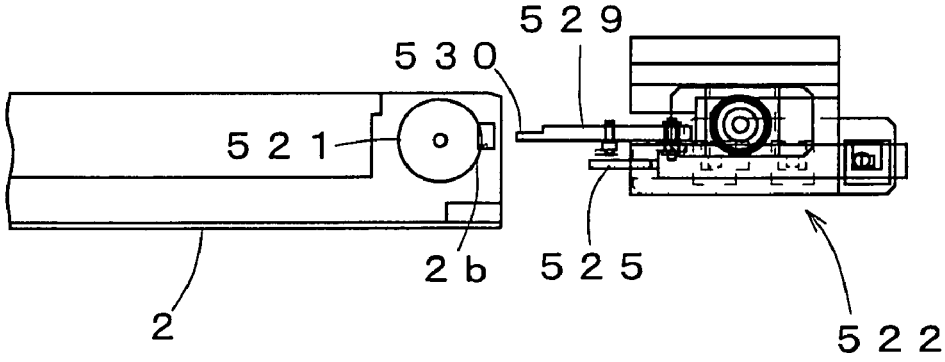
FIG. 32B is a front view of FIG. 32A.

The stopping/retaining member 529 is linked to a support piece 534 extensively provided on the pusher body 523 so as to be rotatable around a spindle 535. Moreover, a guide pin 536 protruding from the upper face of the rack gear 521 is slidable in the long hole 532 on the stopping/retaining member 529. When the guide pin 536 slides along a straight line part 532*a* (a portion along the protruding direction of the rack gear 521) of the long hole 532, the stopping/retaining member 529 is rotated to a protruding position along the rack gear 521 as shown in FIGS. 30A and 30B, and at this protruding position, the stopping hook part 530 may be stopped by the stopping hole 2*b* of the cassette 2. Further, when the guide pin 536 slides a inclined part 532*b* (a portion formed on the inclined piece 531) of the long hole 532, the stopping/retaining member 529 is rotated to a retreat position inclined to the rack gear 521 as shown in FIGS. 32A and 32B. At the retreat position, even if the pusher 522 is moved to each of the cassettes 2, the stopping/retaining member 529 will not interfere with the cassette 2.

With the pusher 522 having a thus-structured stopping/retaining member 529, when medicines D are dispensed based on the prescription data, not only the medicines D can dispensed from the cassette 2, but also the cassette 2 can be prevented from being dismounted from the stock shelf 3.

More particularly, if the pusher 522 is moved to a cassette 2 containing a pertinent medicine D and the motor 526 is driven to move the rack gear 524 forward, the guide pin 536 slides from the inclined part 532*b* to the straight line part 532*a* of the long hole 532 with the forward movement as shown in FIGS. 30A and 30B, and the stopping/retaining member 529 rotates around the spindle 535 from the retreat position to the protruding position. Consequently, the stopping hook part 530 is stopped by the stopping hole 2*b* of the cassette 2 in a locked state, which prevents the cassette 2 during dispensing processing from dismounting from the stock shelf 3.

Figure 31A:
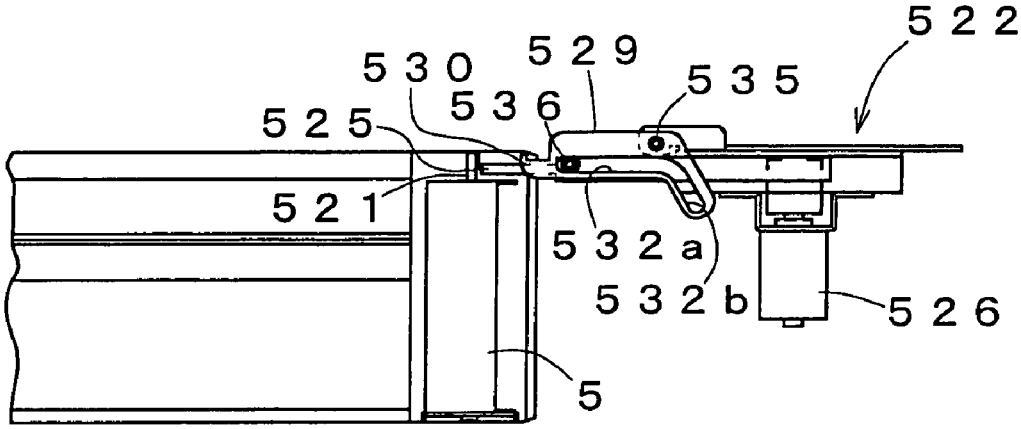
FIG. 31A is a fragmentary plane view showing the state in which the stopping/retaining member of the pusher shown in FIG. 29 is rotated to the protruding position and a pusher rod is protruded.
Figure 31B:
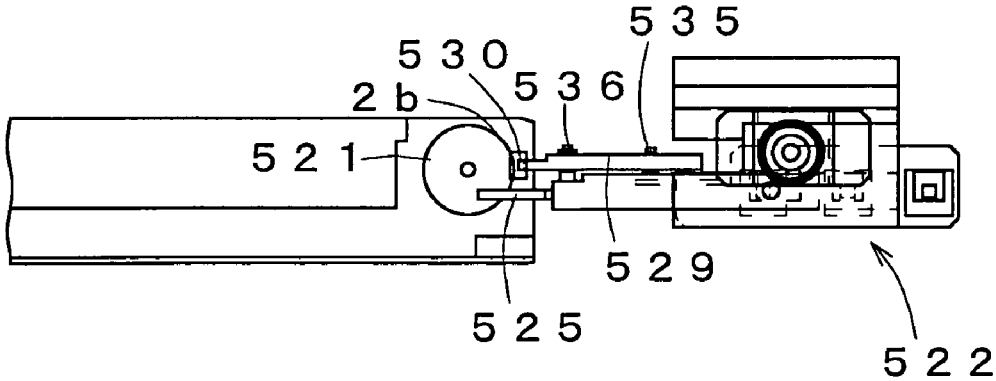
FIG. 31B is a front view of FIG. 31A.

Then, in the locked state, as shown in FIGS. 30A, 30B, as well as FIGS. 31A, 31B, the motor 526 is driven for reciprocal rotation, so that the rack gear 524 is reciprocated and the rack gear 521 is pressed specified times by the pusher rod 525 according to the prescription data, by which the rotor 5 is rotated to dispense a specified quantity of medicines. During this process, the guide pin 536 reciprocates in the straight line part 532*a* of the long hole 532 so that the locked state by the stopping/retaining member 529 is maintained.

Then, upon completion of dispensing of the medicines, the motor 526 is driven to rotate in the reverse direction so as to move the rack gear 524 backward as shown in FIGS. 32A and 32B. By this, the guide pin 536 slides from the straight line part 532*a* to the inclined part 532*b* of the long hole 532, and the stopping/retaining member 529 rotates to the retreat position. Consequently, the stopping hook part 530 is disengaged from the stopping hole 2*b* of the cassette 2, which allows the cassette 2 to be dismounted from the stock shelf 3.

Thus, by providing the stopping/retaining member 529 to the pusher 522, it is not necessary to impart the locking mechanism to each of the stock shelves 3, which can prevent such failure that the cassette 2 during dispensing processing is dismounted and medicines D remain in the device. Further, since only the cassette 2 during dispensing processing can be locked, an operation to charge other cassettes 2 with medicines can be performed, making it possible to enhance workability. Further, providing the locking mechanism to the respective stock shelves 3 requires on/off control in the respective mechanisms, thereby causing cost increase. However, in the present embodiment, the simple constitution of the stopping/retaining member 529 provided on the pusher 522 allows cost reduction.

What is claimed is:

1. A medicine dispensing device comprising:

a dispensing device body;

a cassette fixed removably to the dispensing device body in order to contain medicines in a linear arrangement; and a pushing mechanism for pushing out the medicines in the cassette toward one end side thereof, the cassette including a cover for covering all of the linearly arranged medicines contained therein, and a stopping/receiving part disposed internally and in a longitudinal direction of the cassette, wherein all of the medicines are exposed when the cover is moved to an open position, the pushing mechanism including an abutting part contained in the cassette and adapted to abut against the medicines contained therein, a biasing part for biasing the abutting part against the medicines so as to press the medicines from one end side, and a stopping part stopping at the stopping/receiving part of the cassette only when the cover is opened so that the abutting part is prevented from pressing the medicines in conformity to biasing force of the biasing part, wherein when the abutting part is moved, the stopping part is released from the stopping/receiving part and the abutting part is moved to an arbitrary position so as to allow positioning.

2. The device for dispensing medicine as defined in claim 1, wherein the pushing means is constituted such that the biasing part and the stopping part are housed in a casing and one end face of the casing functions as the abutting part.

3. The device for dispensing medicine as defined in claim 1, wherein the cassette includes fallout preventing means for preventing contained medicines from falling out in a state that the cassette is dismounted from the dispensing device body, and the dispensing device body includes a canceling part for canceling fallout prevention by the fallout preventing means when the cassette is mounted and a dispensing part for allowing the medicines in the cassette to be dispensed one by one.

4. The device for dispensing medicine as defined in claim 1, wherein the stopping/receiving part is constituted of a stopping rack composed of a plurality of recess parts juxtaposed along a longitudinal direction of the cassette, and the stopping part has a gear which rotates in response to opening and closing operation of the cover to engage with the stopping rack.

5. The device for dispensing medicine as defined in claim 4, wherein the pushing means includes a gear engaged with the stopping rack and an oil damper integrated with the gear, and the biasing part is constituted of a constant-load spring.

6. The device for dispensing medicine as defined in claim 3, wherein the dispensing part is constituted of a rotor having a circular plane allowing medicines to be held one by one, the rotor being rotated by power transmitted through a gear provided on a rotating shaft, the gear being engaged with a rack formed on a rod, the rod being able to reciprocate.

7. The device for dispensing medicine as defined in claim 3, wherein the dispensing part is constituted of a rotor having a circular plane allowing medicines to be held one by one, the rotor being rotated by power transmitted through a gear provided on a rotating shaft, the gear being engaged with a drive gear which drives rotationally, the drive gear being able to come into contact with or break away from the gear of each rotor in a plurality of cassettes.

8. The device for dispensing medicine as defined in claim 3, wherein the fallout prevention means is constituted of a plate spring provided on one end aperture of the cassette, the plate spring being elastically deformable from being at a fallout prevention position for preventing medicines from falling out from the cassettes to being at a medicine dispensing position for permitting the dispensing part to dispense medicines.

9. The device for dispensing medicine as defined in claim 8, wherein the dispensing part is constituted of a rotor having a circular plane allowing medicines to be held one by one the rotor being rotated by power transmitted through a gear provided on a rotating shaft, and wherein the plate spring elastically supports a head medicine so as not to move a position of a next medicine when the head medicine received on the circular plane of the rotor is dispensed from the cassette by rotation of the rotor.

10. The device for dispensing medicine as defined in claim 1, wherein the dispensing device body includes a pusher for driving the dispensing part of the cassette to dispense medicines and a stopping/retaining member geared to the pusher to engage with or disengage from the cassette.

11. The device for dispensing medicine as defined in claim 4, wherein the dispensing device body includes a dispensing part for allowing the medicines in the cassette to be dispensed one by one, and wherein the dispensing part is constituted of a rotor having a circular plane allowing medicines to be held one by one, the rotor being rotated by power transmitted through a gear provided on a rotating shaft, the gear being engaged with a rack formed on a rod, the rod being able to reciprocate.

12. The device for dispensing medicine as defined in claim 4, wherein the dispensing device body includes a dispensing part for allowing the medicines in the cassette to be dispensed one by one and wherein the dispensing part is constituted of a rotor having a circular plane allowing medicines to be held one by one, the rotor being rotated by power transmitted through a gear provided on a rotating shaft, the gear being engaged with a drive gear which drives rotationally, the drive gear being able to come into contact with or break away from the gear of each rotor in a plurality of cassettes.

13. The device for dispensing medicine as defined in claim 4, wherein the cassette includes fallout preventing means for preventing contained medicines from falling out in a state that the cassette is dismounted from the dispensing device body, and wherein the fallout prevention means is constituted of a plate spring provided on one end aperture of the cassette, the plate spring being elastically deformable from a fallout prevention position for preventing medicines from falling out from the cassettes to a medicine dispensing position for permitting the dispensing part to dispense medicines.

14. The device for dispensing medicine as defined in claim 1, wherein the cover extends along a longitudinal direction of the cassette and includes a pressing part, extending along the longitudinal direction of the cassette, for abutting the linearly arranged medicines in a closed position of the cover.

* * * * *